US010381206B2

(12) United States Patent
Roukes et al.

(10) Patent No.: US 10,381,206 B2
(45) Date of Patent: Aug. 13, 2019

(54) INTEGRATED HYBRID NEMS MASS SPECTROMETRY

(71) Applicants: CALIFORNIA INSTITUTE OF TECHNOLOGY, Pasadena, CA (US); THERMO FISHER SCIENTIFIC (BREMEN) GMBH, Bremen (DE)

(72) Inventors: Michael L. Roukes, Pasadena, CA (US); Alexander A. Makarov, Bremen (DE)

(73) Assignees: California Institute of Technology, Pasadena, CA (US); Thermo Fisher Scientific (Bremen) GmbH, Bremen (DE)

( * ) Notice: Subject to any disclaimer, the term of this patent is extended or adjusted under 35 U.S.C. 154(b) by 185 days.

(21) Appl. No.: 15/544,225

(22) PCT Filed: Jan. 22, 2016

(86) PCT No.: PCT/US2016/014454
§ 371 (c)(1),
(2) Date: Sep. 25, 2017

(87) PCT Pub. No.: WO2016/118821
PCT Pub. Date: Jul. 28, 2016

(65) Prior Publication Data

US 2018/0005809 A1 Jan. 4, 2018

Related U.S. Application Data

(60) Provisional application No. 62/107,254, filed on Jan. 23, 2015.

(51) Int. Cl.
*H01J 49/00* (2006.01)
*H01J 49/06* (2006.01)
(Continued)

(52) U.S. Cl.
CPC ..... *H01J 49/0013* (2013.01); *H01J 49/0031* (2013.01); *H01J 49/0045* (2013.01);
(Continued)

(58) Field of Classification Search
CPC ..... H01J 49/0013; H01J 49/0031; H01J 49/0045; H01J 49/06; H01J 49/061; H01J 49/26; H01J 49/425
(Continued)

(56) References Cited

U.S. PATENT DOCUMENTS 5,886,346 A 3/1999 Makarov
6,722,200 B2 4/2004 Roukes et al.
(Continued)

OTHER PUBLICATIONS

Sage et al., "Neutral particle mass spectrometry with nanomechanical systems", Nature Communication, 6:6482 (Year: 2015).*
(Continued)

*Primary Examiner* — Nicole M Ippolito
(74) *Attorney, Agent, or Firm* — The Marbury Law Group, PLLC

(57) ABSTRACT

A hybrid mass spectrometer comprising: an ion source for generating ions from a sample, a first mass spectral system comprising a nanoelectromechanical mass spectral (NEMS-MS) system, a second mass spectral system including at least one mass analyzer adapted to separate the charged particles according to their mass-to-charge ratios, and an integration zone coupling the first and second mass spectral systems, the integration zone including at least one directional device for controllably routing the ions to a selected one or both of the first and second mass spectral systems for analysis thereby. The second system can be an orbital electrostatic trap system. The ion beam can be electrically directed to one or the other system by ion optics. A chip with resonators can be used with cooling. Uses include analysis
(Continued)

of large mass complexes found in biological systems, native single molecule analysis, and size and shape analysis.

15 Claims, 7 Drawing Sheets

(51) Int. Cl.
*H01J 49/42* (2006.01)
*H01J 49/26* (2006.01)

(52) U.S. Cl.
CPC ..... *H01J 49/06* (2013.01); *H01J 49/061* (2013.01); *H01J 49/26* (2013.01); *H01J 49/425* (2013.01)

(58) Field of Classification Search
USPC ..... 250/281, 282, 283, 286, 287
See application file for complete search history.

(56) References Cited

U.S. PATENT DOCUMENTS

| | | | | |
|---|---|---|---|---|
| 6,998,609 | B2 | 2/2006 | Makarov et al. | |
| 7,302,856 | B2 | 12/2007 | Tang et al. | |
| 7,330,795 | B2 | 2/2008 | Roukes et al. | |
| 7,399,962 | B2 | 7/2008 | Makarov | |
| 7,408,147 | B2 | 8/2008 | Blick et al. | |
| 7,511,267 | B2 | 3/2009 | Zabrouskov | |
| 7,552,645 | B2 | 6/2009 | Bargatin et al. | |
| 7,555,938 | B2 | 7/2009 | Bargatin et al. | |
| 7,617,736 | B2 | 11/2009 | Tang et al. | |
| 7,714,283 | B2 | 5/2010 | Makarov et al. | |
| 7,724,103 | B2 | 5/2010 | Feng et al. | |
| 7,728,290 | B2 | 6/2010 | Makarov | |
| 7,767,959 | B1 * | 8/2010 | Freidhoff ..... | H01J 49/0018 250/287 |
| 7,767,960 | B2 | 8/2010 | Makarov | |
| 7,985,950 | B2 | 7/2011 | Makarov et al. | |
| 8,044,556 | B2 | 10/2011 | Masmanidis et al. | |
| 8,227,747 | B2 | 7/2012 | Roukes et al. | |
| 8,329,452 | B2 | 12/2012 | Roukes et al. | |
| 8,350,578 | B2 | 1/2013 | Sadek et al. | |
| 8,552,367 | B2 | 10/2013 | Danel et al. | |
| 8,791,409 | B2 | 7/2014 | Makarov et al. | |
| 8,940,546 | B2 | 1/2015 | Grothe, Jr. et al. | |
| 9,016,125 | B2 | 4/2015 | Andreucci et al. | |
| 9,117,647 | B2 | 8/2015 | Makarov et al. | |
| 2003/0033876 | A1 | 2/2003 | Roukes et al. | |
| 2007/0057178 | A1 | 3/2007 | Chernushevich et al. | |
| 2008/0073515 | A1 * | 3/2008 | Schoen ..... | H01J 9/062 250/292 |
| 2009/0261241 | A1 | 10/2009 | Roukes et al. | |
| 2012/0199736 | A1 * | 8/2012 | Danel ..... | H01J 49/0018 250/287 |
| 2013/0238252 | A1 | 9/2013 | Perenon et al. | |
| 2014/0156224 | A1 | 6/2014 | Roukes et al. | |
| 2014/0244180 | A1 | 8/2014 | Roukes et al. | |
| 2014/0250980 | A1 | 9/2014 | Hentz et al. | |
| 2015/0017022 | A1 * | 1/2015 | Fomani ..... | F04B 37/02 417/49 |
| 2015/0204827 | A1 * | 7/2015 | Duraffourg ..... | G01N 30/7206 250/288 |
| 2015/0301055 | A1 | 10/2015 | Spetzler | |
| 2015/0301058 | A1 | 10/2015 | Schettini et al. | |

OTHER PUBLICATIONS

International Search Report and Written Opinion received in connection with international application No. PCT/US2016/014454; dated Apr. 28, 2016.

MA: "Thermo Scientific Orbitrap Fusion; Tribrid Mass Spectrometer—Product Specifications", Jul. 15, 2013, Retrieved from the Internet: URL:http://planetorbitrap.com/download.php?filename=51ffd84cd2f47.pdf.

Aller et al., Structure of P-Glycoprotein Reveals a Molecular Basis for Poly-Specific Drug Binding. Science, 2009. 323(5922): p. 1718-1722.

Alvarez et al., Soft-Landing of Peptides onto Self-Assembled Monolayer Surfaces†. The Journal of Physical Chemistry A, 2005. 110(4): p. 1678-1687.

Bargatin et al., Large-scale integration of nanoelectromechanical systems for gas sensing applications. Nano Lett, 2012. 12(3): p. 1269-1274.

Barrera et al., The role of lipids in defining membrane protein interactions: insights from mass spectrometry. Trends in cell biology, 2013. 23(1): p. 1-8.

Black, L.W., DNA packaging in dsDNA bacteriophages. Annu Rev Microbiol, 1989. 43: p. 267-92.

Bohrer et al., Biomolecule Analysis by Ion Mobility Spectrometry. Annual Review of Analytical Chemistry, 2008. 1(1): p. 293-327.

Boisen, Mass spec goes nanomechanical, Nature Nanotechnology, vol. 4, 2009, pp. 404-405.

Burg et al., Weighing of biomolecules, single cells and single nanoparticles in fluid. Nature, 2007. 446(7139): p. 1066-1069.

Chan et al., Laser cooling of a nanomechanical oscillator into its quantum ground state. Nature, 2011.478(7367): p. 89-92.

Chaste et al., A nanomechanical mass sensor with yoctogram resolution. Nature Nanotechnology, 2012. 7(5): p. 300-303.

Chen et al., Performance of monolayer graphene nanomechanical resonators with electrical readout. Nature Nanotechnology, 2009. 4(12): p. 861-867.

Cheng et al., Nanotechnologies for biomolecular detection and medical diagnostics, Current Opiniion in Chemical Biology, 2006, 10, 11-19.

Chiu et al., Atomic-scale mass sensing using carbon nanotube resonators. Nano Lett, 2008. 8(12): p. 4342-6.

Cho, Contribution of oncoproteomics to cancer biomarker discovery. Molecular Cancer, 2007. 6.

Cho et al., Oncoproteomics: current trends and future perspectives. Expert Review of Proteomics, 2007. 4(3): p. 401-410.

Cleland, A nanometre-scale mechanical electrometer. Nature, 1998. 392: p. 160-162.

Cleland et al., Noise processes in nanomechanical resonators. Journal of Applied Physics, 2002. 92(5): p. 2758-2769.

Clemmer et al., Naked Protein Conformations: Cytochrome c in the Gas Phase. Journal of the American Chemical Society, 1995. 117(40): p. 10141-10142.

Ekinci et al., Ultrasensitive nanoelectromechanical mass detection. Applied Physics Letters, 2004. 84(22): p. 4469-4471.

Erba, Investigating macromolecular complexes using top-down mass spectrometry, Proteomics, 2014, 14, 1259-1270.

Fang et al., Elevated expressions of MMP7, TROP2, and survivin are associated with survival, disease recurrence, and liver metastasis of colon cancer. International Journal of Colorectal Disease, 2009. 24(8): p. 875-884.

Fong et al., High expression of TROP2 correlates with poor prognosis in pancreatic cancer. British Journal of Cancer, 2008. 99(8): p. 1290-1295.

George, Overview of MEMS/NEMS Technology Development for Space Applications at NASA/JPL, Proceedings of SPIE, vol. 5116 (2003), 136.

Gil-Santos et al., Nanomechanical mass sensing and stiffness spectrometry based on twodimensional vibrations of resonant nanowires. Nature Nanotechnology, 2010. 5(9): p. 641-5.

Goldstein et al., Trop2 identifies a subpopulation of murine and human prostate basal cells with stem cell characteristics. Proceedings of the National Academy of Sciences, 2008. 105(52): p. 20882-20887.

Golovlev et al., Laser-induced acoustic desorption. International journal of mass spectrometry and ion processes, 1997. 169: p. 69-78.

Gupta et al., Single virus particle mass detection using microresonators with nanoscale thickness. Applied Physics Letters, 2004. 84(11): p. 1976-1978.

Hadjar et al., Effect of the Surface on Charge Reduction and Desorption Kinetics of Soft Landed Peptide Ions. Journal of the American Society for Mass Spectrometry, 2009. 20(6): p. 901-906.

(56) References Cited

OTHER PUBLICATIONS

Hadjar et al., "First Observation of Charge Reduction and Desorption Kinetics of Multiply Protonated Peptides Soft Landed onto Self-Assembled Monolayer Surfaces", The Journal of Physical Chemistry C, 2007. 111(49): p. 18220-18225 (Abstract).
Hanahan et al., Hallmarks of Cancer: The Next Generation. Cell, 2011. 144(5): p. 646-674.
Hanay et al: "Single-protein nanomechanical mass spectrometry in real time", Nature Nanotechnology, vol. 7, No. 9, (Aug. 26, 2012), pp. 602-608.
Hanay et al., Inertial Imaging with Nanomechanical Systems. Nature Nanotechnology, vol. 10, 339-344, Apr. 2015.
Heck, Native mass spectrometry: a bridge between interactomics and structural biology. Nat Meth, 2008. 5(11): p. 927-933.
Hilton et al., "Impact energy measurement in time-of-flight mass spectrometry with cryogenic microcalorimeters". Nature, 1998. 391(6668): p. 672-675 (Abstract).
Ilic et al., Attogram detection using nanoelectromechanical oscillators. Journal of Applied Physics, 2004. 95(7): p. 3694-3703.
Jensen et al., An atomic-resolution nanomechanical mass sensor. Nature Nanotechnology, 2008. 3(9): p. 533-7.
Köbel et al., Ovarian carcinoma subtypes are different diseases: implications for biomarker studies. PLoS medicine, 2008. 5(12): p. e232.
LaHaye et al., Nanomechanical measurements of a superconducting qubit. Nature, 2009. 459(7249): p. 960-964.
Lal et al., Regulated Intramembrane Proteolysis: Signaling Pathways and Biological Functions. Physiology, 2011. 26(1): p. 34-44.
Laskin, Ion-surface collisions in mass spectrometry: Where analytical chemistry meets surface science. International Journal of Mass Spectrometry, (0).
Lassagne et al., Ultrasensitive mass sensing with a nanotube electromechanical resonator. Nano Lett, 2008. 8(11): p. 3735-8.
Li et al., Ultra-sensitive NEMS-based cantilevers for sensing, scanned probe and very high-frequency applications. Nature Nanotechnology, 2007. 2(2): p. 114-120.
Li et al., Nanoelectromechanical resonator arrays for ultrafast, gas-phase chromatographic chemical analysis. Nano Lett, 2010. 10(10): p. 3899-903.
Loo, Integrating Native Mass Spectrometry and Top-Down MS for Defining Protein Interactions Important in Biology and Medicine. Mass Spectrometry, 2013. 2(Spec Iss): p. S0013.
Loo, Studying noncovalent protein complexes by electrospray ionization mass spectrometry. Mass Spectrometry Reviews, 1997. 16(1): p. 1-23.
Loo, "Mass spectrometry in the combinatorial chemistry revolution". European Journal of Mass Spectrometry, 1997. 3(2): p. 93-104 (Abstract).
Lorenzen et al., Determination of Stoichiometry and Conformational Changes in the First Step of the P22 Tail Assembly. Journal of Molecular Biology, 2008. 379(2): p. 385-396.
Ma et al., Uncovering the Stoichiometry of Pyrococcus furiosus RNase P, a Multi Subunit Catalytic Ribonucleoprotein Complex, by Surface Induced Dissociation and Ion Mobility Mass Spectrometry. Angewandte Chemie, 2014. 126(43): p. 11667-11671.
Maetzel et al., Nuclear signalling by tumour-associated antigen EpCAM. Nat Cell Biol, 2009. 11(2): p. 162-171.
Maguire et al., A novel chromatography system to isolate active ribosomes from pathogenic bacteria. RNA, 2008. 14(1): p. 188-195.
Marcoux et al., Twenty Years of Gas Phase Structural Biology. Structure, 2013. 21(9): p. 1541-1550.
Marcoux et al., Mass spectrometry reveals synergistic effects of nucleotides, lipids, and drugs binding to a multidrug resistance efflux pump. Proceedings of the National Academy of Sciences, 2013.
McKay et al., "Mass Measurements of Increased Accuracy Resolve Heterogeneous Populations of Intact Ribosomes", J. Am. Chem. Soc., 2006, 128, 11433-11442.
Mikhailov et al., Mass-Selective Soft-Landing of Protein Assemblies with Controlled Landing Energies. Analytical Chemistry, 2014. 86(16): p. 8321-8328.
Miller et al., Soft-Landing of Polyatomic Ions at Fluorinated Self-Assembled Monolayer Surfaces. Science, 1997. 275(5305): p. 1447-1450.
Naik et al., Towards single-molecule nanomechanical mass spectrometry. Nat Nano, 2009. 4(7): p. 445-450.
Nakashima et al., Serological identification of TROP2 by recombinant cDNA expression cloning using sera of patients with esophageal squamous cell carcinoma. International Journal of Cancer, 2004. 112(6): p. 1029-1035.
Omachi et al., Clinical Significance of TROP2 Expression in Colorectal Cancer. Clinical Cancer Research, 2006. 12(10): p. 3057-3063.
Ouyang et al., Preparing Protein Microarrays by Soft-Landing of Mass-Selected Ions. Science, 2003. 301(5638): p. 1351-1354.
Park et al., A mechanical nanomembrane Detector for Time-of-Flight Mass Spectrometry; Nono Lett., 2011, 11, 3681-3684.
Pearson, Contributions to the mathematical theory of evolution. II. Skew variation in homogeneous material. Philosophical Transactions of the Royal Society of London. A, 1895. 186: p. 343-414.
Rietschel et al., The Benefit of Combining nLC-MALDI-Orbitrap MS Data with nLC-MALDI-TOF/TOF Data for Proteomic Analyses Employing Elastase, J. of Proteome Research, 2008, 8, 5317-5324.
Roman et al., A miniature MEMS and NEMS enabled Time-of-Flight Mass Spectrometer for investigations in Planetary Science, 008, Proc. of SPIE vol. 6959 69590G-1.
Rosati et al., Exploring an orbitrap analyzer for the characterization of intact antibodies by native mass spectrometry. Angewandte Chemie International Edition, 2012. 51(52): p. 12992-12996.
Rose et al., High-sensitivity Orbitrap mass analysis of intact macromolecular assemblies. Nature methods, 2012. 9(11): p. 1084-1086.
Sage et al. Neutral Particle Mass Spectrometry with Nanomechanical Systems, Nat. Comm., 2015, DOI:10.1038/ncomms7482 , 2013.
Schmid et al., Real-time single airborne nanoparticle detection with nanomechanical resonant filter-fiber. Sci Rep, 2013. 3: p. 1288.
Shen et al., Soft landing of ions onto selfassembled hydrocarbon and fluorocarbon monolayer surfaces. International Journal of Mass Spectrometry, 1999. 182-183(0): p. 423-435.
Siibak et al., Antibioticinduced ribosomal assembly defects result from changes in the synthesis of ribosomal proteins. Molecular Microbiology, 2011. 80(1): p. 54-67.
Sinha et al., Lysine-specific molecular tweezers are broad-spectrum inhibitors of assembly and toxicity of amyloid proteins. Journal of the American Chemical Society, 2011. 133(42): p. 16958-16969.
Siuzdak et al., Mass spectrometry and viral analysis. Chemistry & Biology, 1996. 3(1): p. 45-48.
Snijder et al., "Analytical Approaches for Size and Mass Analysis of Large Protein Assemblies," Annu. Rev. Anal. Chem. 2014, 7; 43-64.
Snijder et al, "Defining the Stoichiometry and Cargo Load of Viral and Bacterial Nanoparticles by Orbitrap Mass Spectrometry". J. Am. Chem. Soc., 2014, 136 (20), pp. 7295-7299. DOI: 10.1021/ja502616y (Abstract).
Snijder et al, Studying 18 MDa Virus Assemblies with Native Mass Spectrometry. Angewandte Chemie-International Edition, 2013. 52(14): p. 4020-4023.
Stoyanova et al., Regulated proteolysis of Trop2 drives epithelial hyperplasia and stem cell self-renewal via β-catenin signaling. Genes & Development, 2012. 26(20): p. 2271-2285.
Suh et al., Mechanically Detecting and Avoiding the Quantum Fluctuations of a Microwave Field. Science, 2014.
Uetrecht et al., High-resolution mass spectrometry of viral assemblies: Molecular composition and stability of dimorphic hepatitis B virus capsids. Proceedings of the National Academy of Sciences of the United States of America, 2008. 105(27): p. 9216-9220.
Uetrecht et al., "Interrogating viral capsid assembly with ion mobility-mass spectrometry", Nature Chemistry, 2011, vol. 3, pp. 126-132; erratum 745 DOI: 10.1038/NCHEM.947.

(56) References Cited

OTHER PUBLICATIONS

Van Duijn, E., Current limitations in native mass spectrometry based structural biology. J Am Soc Mass Spectrom, 2010. 21(6): p. 971-8.
Verbeck et al., Soft-landing preparative mass spectrometry. Analyst, 2012. 137(19): p. 4393-4407.
Villanueva et al., Surpassing fundamental limits of oscillators using nonlinear resonators. Physical review letters, 2013. 110(17): p. 177208.
Von Helden et al., Conformation of Macromolecules in the Gas Phase: Use of Matrix-Assisted Laser Desorption Methods in Ion Chromatography. Science, 1995. 267(5203): p. 1483-1485.
Wang et al., Surface Modification Using Reactive Landing of Mass-Selected Ions, in Ion Beams in Nanoscience and Technology, R. Hellborg, H.J. Whitlow, and Y. Zhang, Editors.2010, Springer Berlin Heidelberg. p. 37-65.
Wittmer et al., Electrospray Ionization Ion Mobility Spectrometry. Analytical Chemistry, 1994. 66(14): p. 2348-2355.
Xie et al., Top-down ESI-ECD-FT-ICR mass spectrometry localizes noncovalent protein-ligand binding sites. Journal of the American Chemical Society, 2006. 128(45): p. 14432-14433.
Yang et al., Zeptogram-Scale Nanomechanical Mass Sensing. Nano Letters, 2006. 6(4): p. 583-586.
Yin et al., Elucidating the site of protein-ATP binding by top-down mass spectrometry. Journal of the American Society for Mass Spectrometry, 2010. 21(6): p. 899-907.
Zi-Lang et al., Native electrospray and electroncapture dissociation in FTICR mass spectrometry provide top-down sequencing of a protein component in an intact protein assembly. Journal of the American Society for Mass Spectrometry, 2010. 21(12): p. 1966-1968.
Mass Spectrometry: Principles and Applications, 3rd. Ed., E. de Hoffmann and U. Stroobert, 2007.

* cited by examiner

INTEGRATED HYBRID NEMS MASS SPECTROMETRY

RELATED APPLICATIONS

This application claims priority to U.S. provisional application Ser. No. 62/107,254 filed Jan. 23, 2015, which is hereby incorporated by reference in its entirety.

BACKGROUND

Nanoelectromechanical system (NEMS) resonators are electronically and optically controllable, submicron-scale mechanical cantilevers that can be used for exceptionally sensitive mass detection of analytes. Upon adsorption onto a NEMS resonator, analytes can precipitously downshift a resonant frequency of the resonator, which is continuously monitored by specialized electronic circuitry. The induced frequency change is proportional to the mass of the molecule and depends on the landing position on the resonator. Technical solutions enabling this technology can be found, for example, in U.S. Pat. Nos. 6,722,200; 7,302,856; 7,330,795; 7,552,645; 7,555,938; 7,617,736; 7,724,103; 8,044,556; 8,329,452, 8,350,578; and 9,016,125.

These developments have been applied to ultra-sensitive mass detection of biomolecules, including single molecules, as described in, for example, U.S. Pat. Nos. 6,722,200; 8,227,747 and US Patent Publication 2014/156,224. Simple spectra have been assembled by statistical analysis from only a few hundred molecular adsorption events, and in the latest embodiments, with individual molecules.

One of problems needed to be solved for single-molecule analysis was that the resonant frequency shift induced by analyte adsorption depends upon both the mass of the analyte and its precise location of adsorption upon the NEMS resonator. This problem was solved by exciting and detecting multiple vibration modes of the resonator to determine both of these unknowns, as described in US Patent Publication 2014/156,224. Mass resolution of 50-100 kDa has been demonstrated, with significant improvements expected as technology develops further. See, for example, Yang, Y. T., et al., Zeptogram-scale nanomechanical mass sensing. Nano Letters 6, 583-586 (2006).

Nanospray ion source and MS atmosphere-to-vacuum interface were used together with NEMS detection in US Patent Publication 2014/156,224, as well as matrix-assisted laser desorption and ionization source. Cooling the NEMS enhanced non-specific physical adsorption of the arriving analytes on the surface of the devices. By individually measuring the mass of sequentially arriving analyte particles, a mass spectrum representing an entire heterogeneous sample was constructed in US Patent Publication 2014/156,224.

By continuous monitoring of multiple vibrational modes, this approach was then extended in US Patent Publication 2014/244,180 to detection of spatial moments of mass distribution for individual analyte entities, one-by-one, as they adsorb onto a nanomechanical resonator.

Hence, NEMS has become a viable approach to mass spectrometry (MS, NEMS-MS). Particularly important is that NEMS-MS can be used to evaluate neutral molecular species and also that resolving power and sensitivity improves with increasing mass.

Mass spectrometry traditionally addresses identification of analytes by first supplying them with charge in an ion source and then measuring analyte mass-to-charge ratio using electromagnetic fields. In recent years, mass spectrometry has assumed an increasingly important role in the life sciences and medicine and became the main technology for proteomic analysis. Increasing resolution and mass range of modern mass analyzers allows one to measure protein complexes and even virus capsids up to 1-50 MDa using nanospray at native conditions (i.e., at pH close to physiological). For example, it was shown in U.S. Pat. No. 8,791,409 that orbital electrostatic trap mass spectrometry could detect individual ions of protein complexes with mass resolving power in thousands. However, MS based on mass-to-charge ratio typically shows decreasing performance at higher masses, especially because of overlapping charge distributions of MDa analytes.

Despite advances in the art, a need exists to continue to improve and make more versatile the capabilities of mass spectrometry, particularly for solving complex analytical problems with respect to large and complicated biological molecular structures, complexes, and even organelles found in the life sciences. Better methods are needed to determine the vast information available ranging from primary sequence determination to higher-order structure and dynamics for proteins and complexes. Charge state assignment can be difficult for larger, poorly desolvated protein complexes.

SUMMARY

Aspects and embodiments described and/or claimed herein include, for example, mass spectrometer apparatuses, systems and instruments, and methods of using and methods of making the same. Sub-systems and sub-components are also described. In particular, new devices and methods related to NEMS-MS are described.

In one aspect, a mass spectrometer apparatus is provided comprising: at least one hybrid mass spectrometer comprising: an ion source for generating ions from a sample; a first mass spectral system comprising a nanoelectromechanical mass spectral (NEMS-MS) system; a second mass spectral system including at least one mass analyzer adapted to separate the charged particles according to their mass-to-charge ratios; and an integration zone coupling the first and second mass spectral systems, the integration zone including at least one directional device for controllably routing the ions to a selected one or both of the first and second mass spectral systems for analysis thereby.

In one embodiment, the integration zone comprises at least one quadrupole, at least one aperture, and at least one electrostatic lens and optionally one or more deflector, neutral-species filter, or an isolating valve.

In one embodiment, the first and second mass spectral systems are further integrated with use of sequential stages of differential pumping with at least one turbopump.

In one embodiment, the first and second mass spectral systems are further integrated with a system interface comprising a transfer chamber and ion optics.

In one embodiment, the first mass spectral system is adapted to operate at a higher vacuum, lower pressure compared to the second mass spectral system.

In one embodiment, the second mass spectral system comprises an open or closed electrostatic trap (EST) including EST of orbital type, time-of-flight (TOF), Fourier transform ion cyclotron resonance (FT ICR), quadrupole, ion trap, magnetic and electromagnetic, or hybrid mass spectral system. In one embodiment, the TOF is excluded. Here, the second mass spectral system can comprise an open or closed electrostatic trap (EST) including EST of orbital type, Fourier transform ion cyclotron resonance (FT ICR), quadrupole, ion trap, magnetic and electromagnetic, or hybrid mass spectral system.

In one embodiment, the second mass spectral system or the integration zone comprises at least one dissociation or collision cell.

In one embodiment, the second mass spectral system or the integration zone comprises at least one surface-induced dissociation element.

In one embodiment, the NEMS-MS system comprises at least one chip comprising at least one micro-mechanical and/or nano-mechanical resonator.

In one embodiment, the NEMS-MS system comprises at least one chip comprising at least one micro-mechanical and/or nano-mechanical resonator in which the surface of the resonator which is adapted to receive the ion beam and sample is facing toward the second mass spectral system.

In one embodiment, the NEMS-MS system comprises at least one chip comprising a plurality of micro-mechanical and/or nano-mechanical resonators.

In one embodiment, the NEMS-MS system comprises at least one refrigeration sub-system permitting cooling for the NEMS-MS system below ambient temperatures.

In one embodiment, the NEMS-MS system comprises at least one chip comprising at least one micro-mechanical and/or nano-mechanical resonator comprising a resonator surface adapted so that an analyte fragmentation is avoided when the analyte is adsorbed to the resonator surface.

In one embodiment, the NEMS-MS system comprises at least one chip comprising at least one micro-mechanical and/or nano-mechanical resonator comprising a resonator surface adapted for soft landing of an analyte.

In one embodiment, the NEMS-MS system comprises at least one chip comprising at least one micro-mechanical and/or nano-mechanical resonator comprising a resonator surface adapted so that when an analyte is adsorbed to the resonator surface, the analyte can be desorbed from the resonator surface for further analysis.

In one embodiment, the NEMS-MS system comprises at least one chip comprising at least one micro-mechanical and/or nanomechanical resonator, wherein the NEMS-MS system is further adapted for analysis of analyte while the analyte is adsorbed to the at least one micro-mechanical and/or nano-mechanical resonator.

In one embodiment, the mass spectrometer is adapted for external sample introduction into the first mass spectral system and/or external sample introduction into the second mass spectral system.

In one embodiment, the first mass spectral system is adapted for pixel-by-pixel desorption.

In one embodiment, the first mass spectral system is adapted for desorption from the first mass spectral system, wherein desorption is achieved by thermal, electrostatic, acoustic, optical, shock, or piezoelectric-mechanical methods.

In one embodiment, the first and second mass spectral systems are further integrated with use of an electrical directional device which electrically directs the ion beam to the first and/or second mass spectral systems, wherein the directional device is an HCD collision cell, wherein the second mass spectral system comprises a C-trap and an orbital electrostatic trap mass analyzer, and wherein the NEMS-MS system comprises at least one chip comprising a plurality of micro-mechanical and/or nano-mechanical resonators.

Methods of using the apparatuses described and/or claimed herein are also provided. For example, another aspect is for a method for using an apparatus as described and/or claimed herein, wherein a sample is introduced into the apparatus and subjected to analysis in the first and/or second mass spectral systems.

In one embodiment, the sample is subjected to analysis in the first and second mass spectral systems in parallel.

In one embodiment, the sample is subjected to analysis in the first and second mass spectral systems sequentially.

In one embodiment, the sample is subjected to analysis in the first and second mass spectral systems in parallel in full mass range mode.

In one embodiment, the mode of operation of one mass spectral system is chosen dependent on data obtained from another system.

In one embodiment, the sample is subjected to analysis in the first and second mass spectral systems in parallel with a mass filter stepping through different m/z ratios.

In one embodiment, the sample is subjected to fragmentation.

In one embodiment, the method is used to measure degree of solvation and/or intact molecular mass, charge state determination, or any other parameter of the molecule.

In one embodiment, the sample is subjected to additional analysis while present on a resonator of the NEMS-MS system.

In one embodiment, the analysis includes single molecule analysis.

In one embodiment, the analysis is native single molecule analysis.

In one embodiment, the sample is introduced under native conditions.

In one embodiment, the analysis includes inertial imaging for providing measurement of a spatial distribution of mass.

In one embodiment, the sample is analyzed under conditions for soft landing.

In one embodiment, the sample analysis includes desorption.

In one embodiment, the sample analysis includes desorption, wherein desorption is achieved by thermal, electrostatic, or optical methods.

In one embodiment, the sample is subjected to dissociative SID, CID, UVPD, or acoustically-based dissociation.

In one embodiment, the sample is subjected to protein sequencing.

In one embodiment, the sample is a heterogeneous sample and heterogeneous physisorption occurs onto a micro- or nano-mechanical systems array such that coverage is ≤1 analyte per mass-sensing pixel.

In one embodiment, the sample is a heterogeneous sample and heterogeneous physisorption occurs onto a micro- or nanomechanical systems array such that coverage is >1 analytes per mass-sensing pixel, and identification of populations of >1 analytes is determined.

In one embodiment, the sample is a heterogeneous sample and heterogeneous physisorption occurs onto a micro- or nanomechanical systems array such that coverage is >1 analytes per mass-sensing pixel, and identification of populations of >1 analytes is determined by inertial imaging.

In one embodiment, the sample is a heterogeneous sample and heterogeneous physisorption occurs onto a micro- or nano-mechanical systems array such that coverage is ≤1 analyte per mass-sensing pixel, wherein each adsorbed species is subjected to programmed desorption followed by further analysis of the desorbed species.

In one embodiment, the sample is a heterogeneous sample and heterogeneous physisorption occurs onto a micro- or nanomechanical systems array such that coverage is >1 analytes per mass-sensing pixel, wherein each adsorbed species is subjected to programmed desorption followed by further analysis of the desorbed species.

Another aspect is a method of analyzing molecules comprising: generating ions in an ion source from a sample of molecules to be analyzed; analyzing at least some of said ions according to their mass-to-charge ratio in a mass analyzer; obtaining spectra of analyzed ions; wherein mass analysis is complemented by: diverting at least some of ions from the ion source to an electromechanical device that measurably changes one of its characteristics upon adsorption of a single ion to be analyzed; measuring change of said characteristics upon adsorption for a multitude of adsorbed ions and converting its amplitude into characteristics of mass distribution within each ion; wherein statistical distributions from multiple measurements are used for assigning charge state and mass of peaks in a spectrum obtained by mass analyzer.

In one embodiment, the mass analyzer is an orbital electrostatic trap mass analyzer. In another embodiment, the electromechanical device comprises one or more micro-mechanical and/or nano-mechanical resonators.

A variety of advantages can be found from one or more instrumental and method embodiments described herein. These advantages cover many areas of analytical applications and are not limited to just life science applications, although life science is a leading focal point. Among examples: the instruments and methods also can allow sensitive analysis of nanoparticles, for example, characterizing rare species in heterogeneous populations of species; they can also provide further testing of nanosensors such as sensors based on, for example, ultrathin semiconductors and graphene.

For example, the instruments and methods described herein in some embodiments can enable quantitative analysis of high-mass macromolecular complexes including both overall structure as well as the structure of sub-components. For example, molecular size and shape, density, and physical properties can be analyzed, and high resolution can be achieved.

In addition, in some embodiments, measurement of single molecules and species are possible rather than mere measurements of statistical distributions of single molecules and species.

In addition, native mass spectral analysis is possible in some embodiments.

Moreover, stratification can be achieved in analysis of molecularly distinct sub-populations present within complex biological samples, which provides, for example, excellent structure/function information.

In many embodiment, precise, high-flux delivery of preselected biomolecular species and their dissociative post-analysis can be achieved.

Many other advantages for at least some embodiments are noted throughout this application.

DETAILED DESCRIPTION

Introduction

Figure 1A:
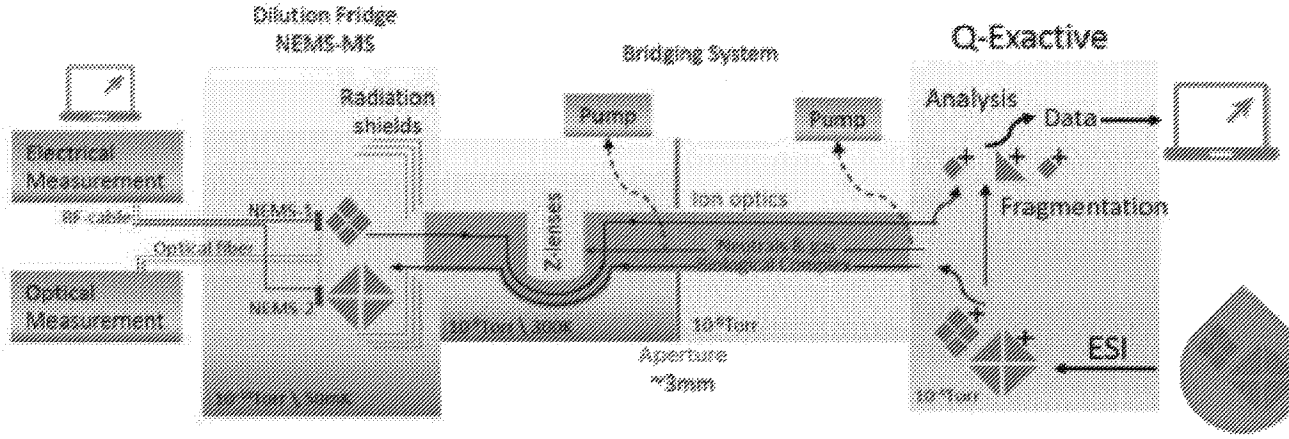
FIGS. 1A (top) and 1B (bottom) illustrates conceptual and functional schematics for one embodiment for a hybrid NEMS-orbital electrostatic trap mass spectral instrument. The schematics combine an atmospheric-pressure ion source, an atmosphere-to-vacuum interface, a quadrupole mass filter, an orbital electrostatic trap mass analyzer, and a NEMS device in a differentially pumped chamber behind collision cell and transfer optics.

Priority U.S. provisional application Ser. No. 62/107,254 filed Jan. 23, 2015 is hereby incorporated by reference in its entirety including the figures, background, and cited references.

All references cited herein are incorporated herein by reference in their entirety, and no admission is made that any of these references are prior art.

One broad aspect provides for a mass spectrometer apparatus comprising: at least one hybrid mass spectrometer adapted to function with at least one ion beam comprising at least one sample, the spectrometer comprising: at least one first mass spectral system, and at least one second, different mass spectral system integrated with the first mass spectral system, wherein the first mass spectral system comprises at least one nanoelectromechanical mass spectral (NEMS-MS) system, and the second mass spectral system measures mass-to-charge ratio. The integration of the two systems can be carried out with a variety of embodiments as described and/or claimed herein.

For example, another aspect provides for a mass spectrometer apparatus comprising: at least one hybrid mass spectrometer adapted to function with at least one ion beam comprising at least one sample, the spectrometer comprising: at least one first mass spectral system, and at least one second, different mass spectral system integrated with the first mass spectral system with an integration zone which separates the first and second mass spectral systems and contains ion optical elements, wherein the first mass spectral system comprises at least one nanoelectromechanical mass spectral (NEMS-MS) system, and the second mass spectral system measures mass-to-charge ratio and ion beam could be directed to first or second mass spectral system by electrically switching ion optical elements.

In another exemplary aspect, a mass spectrometer apparatus is provided comprising: at least one hybrid mass spectrometer comprising: an ion source for generating ions from a sample; a first mass spectral system comprising a nanoelectromechanical mass spectral (NEMS-MS) system; a second, different mass spectral system including at least one mass analyzer adapted to separate the charged particles according to their mass-to-charge ratios; and an integration zone coupling the first and second mass spectral systems, the integration zone including at least one directional device for controllably routing the ions to a selected one or both of the first and second mass spectral systems for analysis thereby.

Additional detailed description is provided herein for these and other aspects, wherein hybrid instruments are described followed by methods of using the instruments. Additional embodiments and a working demonstration of the instrument are also provided.

Mass Spectrometer Apparatus and Hybrid Mass Spectrometer

Mass spectrometer apparatuses of various kinds are known in the art and commercially available. See, for example, Mass Spectrometry: Principles and Applications, 3rd. Ed., E. de Hoffmann and U. Stroobert, 2007. This book describes, for example, ion sources, different types of mass analyzers, detectors and computers, tandem mass spectrometry, analytical information, fragmentation reactions, and analysis of biomolecules, among other topics. The various types of mass analyzers include, for example, quadrupole, ion trap (both 3D and 2D), electrostatic trap, time-of-flight (TOF), magnetic and electromagnetic, ion cyclotron resonance and fourier transform (ICR FT), and hybrids. Basic principles of mass spectrometry instrumentation and methods are well-known including, for example, sample inlets, ionization sources, mass analyzers, ion optics, detectors, and data processing.

In most cases, the mass spectrometer is measuring the mass of a sample or analyte based on mass-to-charge ratio (as used herein, a "sample" is a broad term and can include both an initial sample subject for ionization and analysis, as well as fragmentation product samples or pre-selected samples; samples can be simple or complex, homogeneous or heterogeneous). However, the NEMS-MS methods are able also to measure a neutral sample or ions with very low charge to mass ratio. An ion beam is typically used for analysis of the ionized sample using the mass-to-charge ratio. Computers can control the input and outputs of the instruments, and methods and feedback processes can be used for instrument and method control.

It is also known in the art to combine multiple mass spectral analyses into a single analytical process. For example, tandem mass spectrometry or hybrid mass spectrometers are known. For example, in a tandem process, a precursor ion may be first subject to analysis, and then it is disassociated into fragments, and the fragments can be further analyzed. In such cases, the different parts of the tandem or hybrid mass spectrometer must be integrated to function together. Integration can be carried out by building from first principles a new instrument, or it can be carried out by adapting a known mass spectral system (which might be commercially available) to function with another, different mass spectral system.

Herein, a hybrid mass spectrometer is provided comprising a first mass spectral system and a second mass spectral system different from the first. The first mass spectral system is based on a NEMS-MS system, whereas the second mass spectral system is based on a different system which is not a NEMS-MS system but rather measures mass-to-charge ratio. The two mass spectral systems need to be integrated to allow them to function together. An integration zone is also present to combine the separate mass spectral systems. The first mass spectral system cannot simply be combined with the second mass spectral system without a discrete integration zone having mechanical structure and volume in space.

Upon integration of the systems, one or more samples can be introduced into both systems for analysis, and the two sets of analysis can be combined to provide results which cannot be found with use of each mass spectral system on its own. The integration zone helps to achieve this integrated approach providing in many cases synergistic results.

Figure 1B:
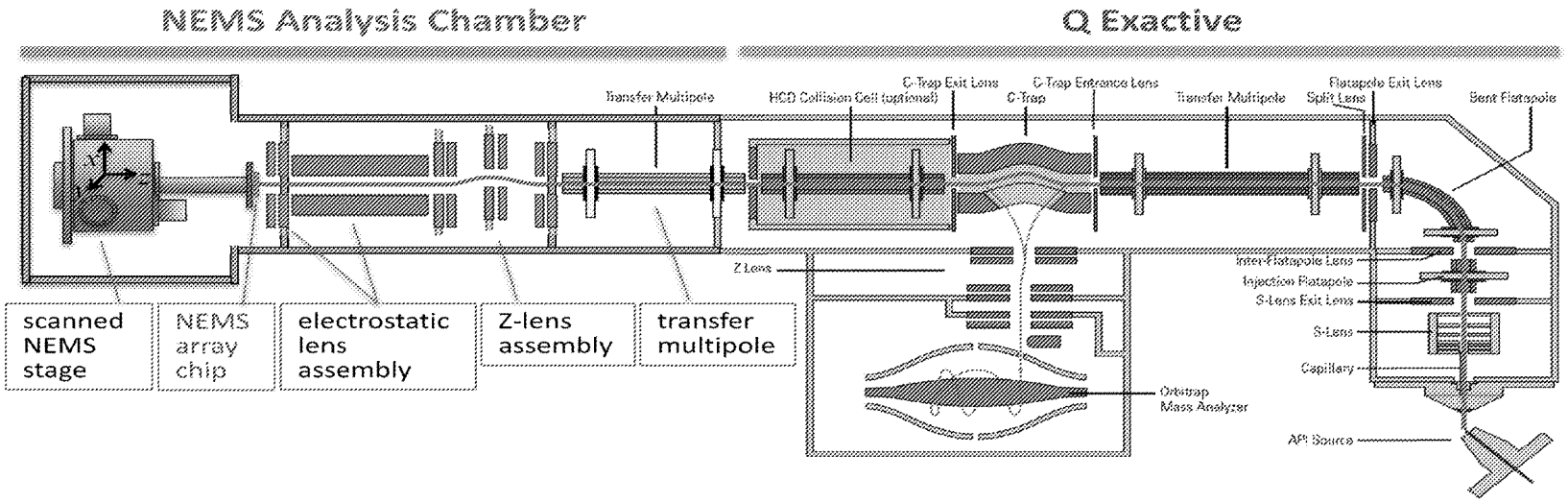

FIGS. 1A and 1B illustrate schematically an embodiment of the hybrid instrument and are described further hereinbelow. In these figures, the first mass spectral system (NEMS-MS) is on the left side, and the second mass spectral system is on the right side. The two systems are integrated in the middle in these figures via the integration zone.

The NEMS-MS system can be derived from known NEMS-MS systems which in the prior art are used alone without an integrated second mass spectral system. References which described such first mass spectral systems include U.S. Pat. Nos. 6,722,200; 7,302,856; 7,330,795; 7,552,645; 7,555,938; 7,617,736; 7,724,103; 8,044,556; 8,329,452, 8,350,578; and 9,016,125, and other references cited herein. The NEMS system can be based on one or more microscale and/or nanoscale mechanical resonators (micromechanical and/or nano-mechanical resonators), which undergo frequency shifts when subjected to mass changes. These individual resonators also can be called mass-sensing pixels, and one can employ a solitary mechanical resonator (one mass-sensing pixel) or an array or plurality of such pixels. A chip or a NEMS chip can include the micromechanical and/or nanomechanical resonator(s) and be integrated physically and electronically with the rest of the instrument. In particular, in one embodiment, the NEMS-MS system comprises at least one NEMS chip comprising at least one micro- or nano-mechanical resonator (or pixel). In another embodiment, the NEMS-MS system comprises at least one NEMS chip comprising a plurality of micro- or nano-mechanical resonators (or pixels). Resonator arrays can be used.

The NEMS-MS system can have low temperature capacity or refrigeration to improve resolution. A variety of low temperature cooling systems are known in the art and are commercially available. They can be adapted to function with the larger instrument. See FIGS. 1A and 1B and working examples below. In one embodiment, the NEMS-MS system comprises a simple flow-through cryostat capable of temperatures from 300K (or above) down to nitrogen liquification, 78K. In another embodiment a liquid helium flow-through cryostat could be employed, capable of temperatures from 300K (or above) down to 4.2K. Variants of the aforementioned systems for cryogenic cooling, including liquid reservoirs of liquid nitrogen, helium, or other cryogens could be employed—as could closed-cycle systems providing access to similar temperature ranges. In another embodiment, at least one dilution refrigeration subsystem could be employed. This could be a cryogen-free dilution refrigerator, or could be based on earlier dilution refrigeration systems employing reservoirs of cryogens requiring periodic refreshment. In another embodiment, the NEMS-MS system comprises at least one NEMS chip, a cryo-positioning stage, and a dilution refrigerator. Typical temperature ranges can range from above room temperature (approximately 300K) down to as low as 2 mK. Other temperature ranges of use include, for example, from about 100 mK to about room temperature (25° C.), or from about 1K, 4K, 50K, 78K, or 100K up to to room temperature. Ions in many cases can desorb at temperatures of, for example, about 150K to 250K—hence the special importance of access to this temperature regime. In another embodiment, the NEMS-MS system comprises a refrigeration system which provides a base temperature of about 8 mK unloaded and about 15 mK or less with an ion load.

The NEMS system and resonator(s) can be adapted to better carry out methods as described herein. For example, one or more resonators can be adapted or one or more instrument sub-systems can be added for analysis of a species adsorbed to the resonator. In Part Two below, various methods are described which can include in some cases description for the instrument also.

In one embodiment, the resonator(s) can be adapted to include at least one surface film which controls, for example, interaction, adhesion promotion, adhesion reduction, adsorption, desorption, reduce charge neutralization, reduce surface diffusion, and the like, of an analyte or sample. The film can be a thin film such as a film having a thickness of a monolayer or a thickness of, for example, 0.5 nm to 1,000 nm, 1 nm to 1,000 nm, 2 nm to 500 nm, or 2 nm to 100 nm, for example. The film can be an inorganic film or an organic film. The film can comprise, for example, self-assembled monolayers. The film can be deposited from solution from an ink, or it can be vapor deposited. Preferred embodiments can include halogen rich species, including fluorinated hydrocarbons, or, alternatively, could be optionally-substituted alkane thiol monolayers, silane-chemistry based monolayer or, alternatively, mono- or multiple-layers deposited by atomic layer deposition methods or variants thereof. A particularly preferred embodiment is optionally substituted alkane thiol monolayer.

One embodiment is multi-layer films in which each layer has a different function. For example, one layer can preserve the charge of the analyte. Another layer can provide for adhesion. The preservation of charge state of an incoming ion and control of the adhesion to the NEMS can be termed passivation.

For example, in one embodiment, the NEMS-MS system comprises at least one NEMS chip comprising at least one nano-mechanical and/or micro-mechanical resonator comprising a resonator surface adapted so that an analyte (or sample) fragmentation is avoided when the analyte is adsorbed to the resonator surface. In another embodiment, the NEMS-MS system comprises at least one NEMS chip comprising at least one micro-mechanical and/or nano-mechanical resonator comprising a resonator surface adapted for soft landing of an analyte. Soft landing is a term known in the art and described more hereinbelow with cited references.

In another embodiment, the NEMS-MS system comprises at least one NEMS chip comprising at least one micro-mechanical and/or nano-mechanical resonator comprising a resonator surface adapted so that when an analyte is adsorbed to the resonator surface, the analyte can be desorbed from the resonator surface for further analysis. For example, further analysis can be carried out with the second mass spectral system. In another embodiment, the NEMS-MS system is adapted to include a collection receptacle opposite a NEMS array for collection of analyte desorbed from the NEMS array.

Desorption can be carried out by various methods including thermal, electrostatic, or optical, as described more below.

In another embodiment, the NEMS-MS system comprises at least one NEMS chip comprising at least one micro-mechanical and/or nanomechanical resonator, wherein the NEMS-MS system is further adapted for analysis of analyte while the analyte is adsorbed to the at least one micro-mechanical and/or nano-mechanical resonator. Analysis can be carried out by one or a plurality of methods, as described more below. The larger instrument can include the equipment need to do such further analysis of the analyte while present on the resonator. For example, if calorimetry is to be done, a calorimeter can be added to the larger instrument and in the first mass spectral system. If IR analysis is to be done, an IR instrument can be included in the first mass spectral system. This embodiment is particularly of interest when the resonator has only one species adsorbed to it.

As described above, the first mass spectral system is integrated with a second, different mass spectral system. The second mass spectral system, which measures mass-to-charge ratio, can be derived from known mass spectral systems which, often, in the prior art are used alone without an integrated first mass spectral system. Examples of the second mass spectral systems include, for example, electrostatic trap (open or closed), quadrupole, ion trap (both 3D and 2D), time-of-flight, magnetic and electromagnetic, ICR FT, and even a hybrid system which can be integrated with the first mass spectral system. In particular, the second mass spectral system can comprises an open or closed electrostatic trap (EST) including EST of orbital type, time-of-flight (TOF), Fourier transform ion cyclotron resonance (FT ICR), quadrupole, ion trap, magnetic and electromagnetic, or hybrid mass spectral system.

In a preferred embodiment, the second mass spectral system is an ion trap mass spectral system, or an electrostatic trap mass spectral system, or more preferably, the second mass spectral system is an orbital electrostatic trap mass spectral system.

As known in the art, trapping mass analyzers refer to mass analyzers in which ions are confined by electric fields, or a combination of electric and magnetic fields (in the case of ICR), during mass analysis. The most common types of trapping mass analyzers are the quadrupole ion trap, which utilizes a substantially quadrupolar field established by application of RF voltages to the trap electrodes for ion confinement, and the electrostatic trap (in particular the orbital electrostatic trap), which utilizes a static field for ion confinement.

In one embodiment, the second mass spectral system comprises a C-trap and an orbital electrostatic trap mass analyzer. In one embodiment, the second mass spectral system comprises a quadrupole mass filter. In one embodiment, the second mass spectral system comprises at least one collision cell. In one embodiment, the second mass spectral system comprises at least one higher-energy collisional dissociation (HCD) cell.

Representative technical literature describing an orbital electrostatic trap mass spectral system includes, for example, U.S. Pat. Nos. 5,886,346; 6,998,609; 7,399,962; 7,511,267; 7,714,283; 7,728,290; 7,767,960; 7,985,950; 8,940,546; and 9,117,647. The orbital electrostratic trap method and instrument provides numerous advantages including, for example, good sensitivity, high resolution, mass accuracy, space charge capacity, linear dynamic range, and relatively small size and cost. It relies on, among other things, especially shaped central and outer electrodes. Mass analysis is carried out by Fourier Transform (FT) analysis of a transient signal produced on detector electrodes by the movement of the ions. Although it operates in a pulsed fashion, it can be coupled to continuous ion sources. Ion storage devices make possible this coupling.

In one embodiment, the first and second mass spectral systems are integrated with use of an electrical directional device which electrically directs the ion beam to the first and/or second mass spectral systems. This approach, using an electrical directional device, is different from, for example, a limited system wherein an ion beam is directed to a NEMS-MS device including a resonator for analysis, and if desired, the NEMS resonator can be physically moved away from the path of the beam, so that the beam then enters a second mass spectral system. Such a limited approach is described in a Sage et al. reference, *Nature Communications,* 2015, DOI:10.1038/ncomms7482. In this alternative, limited approach, the ion beam is not electrically directed with options for direction or switching among the two systems so the approach is very limited. In the versatile electrical directional device approach, the ion beam can be moved throughout the instrument depending on the experiment to be done (as used herein, the term "ion beam" denotes a spatially dispersed group of ions, and should not be construed as limiting the operation to a continuous or quasi-continuous beam). Therefore, the approach of Sage et al. does not allow a parallel or cascaded analysis as the beam is sent to a TOF analysis OR to the NEMS analysis, so that the TOF and NEMS separately do an analysis. Generally speaking, there is no difference between this system versus two individual systems in term of information obtained. Another difference is that the Sage reference is limited where the resonator surface which faces the beam faces away from the TOF system. This makes it more difficult for a species which interacts with the resonator to also be analyzed by TOF system.

The path of the ion beam can be controlled by methods known in the art, for example, by generating an electric field that can be used to direct the beam. The beam pathway can be even reversed if desired. A variety of directional devices, switching devices, or electrical directional devices can be used. Generally described, such devices include one or more electrodes to which controllable (oscillatory and/or static) voltages are applied, and may take the form of lenses, guides, and deflectors. Control of ion movement may also be achieved by other methods, including shutters that selectively physically block the ion path. The directional device is operative, under the control of a control/data system, to cause ions produced in the ionization source(s) to be routed to a selected one or both of the first and second mass spectral systems for analysis in accordance with a desired technique. For example, the directional device may be operated to concurrently route ions to the first and second mass spectral systems such that portions of the ion population are simultaneously analyzed by NEMS and conventional mass spectrometry. In other examples, the directional device may be operated such that ions are serially analyzed in the first and second mass spectral systems, e.g., first in the NEMS analyzer and then in the orbital electrostatic ion trap (or other mass analyzer). The directional device may also be operated to route ions returned from the NEMS analyzer (e.g., by programmatic desorption of a selected species) to the orbital electrostatic ion trap for analysis, or to a collision cell or other dissociation region for generation of product ions. In certain embodiments, the directional device may perform a mass-selective or mass discriminatory function, such that ions having a first range of m/z values are routed to the first (NEMS) mass spectral system while ions of another range of m/z values are routed to the second (orbital electrostatic trap) mass spectral system. The directional device may alternatively be adapted to perform a discriminatory or separation function on the basis of a different ion characteristic or property, such as mobility. The directional device may be operated in a data-dependent fashion, wherein the state of its operation is determined by results obtained substantially in real-time at one or both mass spectral systems, wherein NEMS could be used to measure not only mass but also shape and other characteristics as described below.

Integration of the two mass spectral systems, including the integration zone and an electrical directional device, can be further achieved by a variety of methods and devices which allow an ion beam to pass into one or both of the mass spectral systems, but in one embodiment, the first and second mass spectral systems are further integrated with use of ion optics.

In another embodiment, the first and second mass spectral systems are further integrated with use of at least one quadrupole, at least one aperture, and at least one ion lens. In another embodiment, the integration zone comprises at least one quadrupole, at least one aperture, and at least one electrostatic lens and optionally one or more deflector, neutral-species filter, or an isolating valve In another embodiment, the first and second mass spectral systems are further integrated with use of at least one stack of z-lenses.

In another embodiment, the first and second mass spectral systems are further integrated with use of at least one electrostatic beam shutter.

In another embodiment, the first and second mass spectral systems are further integrated with use of at least one neutral-species filter.

In another embodiment, the first and second mass spectral systems are further integrated with use of sequential stages of differential pumping.

In another embodiment, the first and second mass spectral systems are further integrated with a system interface comprising a transfer chamber and ion optics.

In another embodiment, the first and second mass spectral systems are further integrated with a system interface comprising at least one transfer quadrupole and at least one electrostatic lens assembly.

In another embodiment, the first and second mass spectral systems are further integrated with a system interface which is adapted to guide an ion beam between the two systems, the interface comprising at least one quadrupole, at least one aperture, and at least one ion lens.

In another embodiment, the first and second mass spectral systems are further integrated with a system interface which is adapted to guide an ion beam between the two systems, the interface comprising an intermediate stack of Z-lenses serving as both an electrostatic beam shutter and a neutral-species filter.

In another embodiment, the first and second mass spectral systems are adapted to operate and do operate at different vacuums and pressures. For example, the first mass spectral system can be adapted to operate and does operate at a higher vacuum, lower pressure compared to the second mass spectral system.

In another embodiment, the first and second mass spectral system are further integrated with at least one turbopump.

In another embodiment, the first and second mass spectral systems are further integrated with at least one system isolating gate valve.

Finally, additional description is provided for the rationale behind and need for the new hybrid instrument described herein in which NEMS-MS, a first mass spectral system, is integrated with a second mass spectral system, as described in U.S. provisional application 62/107,254.

Existing techniques for mass spectrometry usually result in a degradation of mass resolution with increasing analyte mass, m. Hence, measurement of large complexes (e.g., greater than 200 kDa) requires extensive system modifications and has been achieved in only customized systems. Even on these systems, however, charge-based measurements result in an increased spread of mass-to-charge ratio with increasing analyte size (see FIG. 4 U.S. provisional 62/107,254 and reference 6). By contrast, NEMS-MS is readily applicable to analytes with masses above several hundred kDa. Crucially, the mass resolution of a nanomechanical system, δM, is dependent only on frequency noise—thus, mass resolution, m/δM, actually increases with increasing analyte mass. [4].

With existing methodologies and instrumentation the identification of species within complex samples can be difficult [62-64]. Issues arise from the charged-based methods conventional mass spectrometry employs for analyte transport, separation, and detection. Deconvolving multiple charge-states often requires use of highly purified samples [65-67]. Issues related to adduct formation [67] also lead to peak broadening, which reduces mass resolution. NEMS-MS is neutral analysis technique [68]; hence, it can avoid issues related to charge-state deconvolution. The ability of nanomechanical mass spectrometry to analyze complex samples is limited only by the mass resolution of the technique, which is itself independent of analyte charge. Accordingly, NEMS-MS can provide enhanced discrimination of complex mixtures. Obtaining proteomic profiles directly from the cell lysate—important in life sciences and medical applications (see, e.g., Application 4 below)—will be enhanced through continued improvement to nanomechanical device technology enabling increasingly higher levels of mass and size resolution.

One of the most common techniques for size measurement, often combined with mass spectrometry, is ion mobility spectrometry (IMS). See, for example, Lanucara et al., *Nat. Chem.,* 6, 281-294 (2014). IMS provides a measure of analyte size as deduced from their mobility, which is set by collisions with a background gas [69-71]. Though a powerful technique yielding rotationally-averaged structural information on protein complexes [72], IMS does not scale down to single molecule analyses. In this context, measurement of heterogeneous ensembles of analytes can obfuscate detailed information about specific entities. Additionally, the tandem systems often employed for such measurements are less compatible with the high-throughput approach provided by chip-based nanomechanical technology in which, ultimately, thousands of analytes can be measured every second. While IMS can be integrated with embodiments described herein, the NEMS-MS intertial imaging approach can provide advantages over IMS.

Nanomechanical molecular analysis is unique in its novel approach to measurement of analyte mass, size and molecular shape. The technology operates through direct, inertially-based measurements of particle mass, size, and shape—as opposed to the indirect inference of mass or size from the mass-to-charge ratio or collisional cross section, as in conventional methods. Especially important is that the present approach uniquely enables single-molecule measurements—the aforementioned analyte attributes are measured in real time as the entities sequentially adsorb upon the NEMS.

In a preferred embodiment (see working examples below), a cryogenically cooled NEMS-MS system (a first mass spectral system) is integrated with, for example, a hybrid quadrupole-orbital electrostatic ion trap mass spectrometer (a second mass spectral system). In this new, hybrid instrument mass resolution, mass dynamic range, molecular information, and analyte throughput will be greatly enhanced. The system's base temperature (which, in one embodiment, could operate down to liquid nitrogen or liquid helium temperatures or, in another embodiment, could operate down to the low millikelvin regime—at <8 mK unloaded; about 15 mK with ion load) is important for improving the new instrument's mass resolution, as described below, although NEMS could be also used at rooms up to ambient and above.

The integration of NEMS-MS and, for example, an orbital electrostatic trap MS is not merely a concatenation of commercially available instruments. A system of custom ion optics is required to permit charged protein complexes to be shuffled (without losses) between these systems to permit multiple, sequential stages of analysis. In FIGS. 1A and 1B, conceptual and functional schematics of the integrated NEMS-orbital electrostatic trap system are displayed.

In a preferred embodiment, there are four principal components to the new instrument: i) the orbital electrostatic trap mass spectrometer, ii) the System Interface, iii) the cryogenically cooled NEMS-array analysis stage, and iv) the cryogenic cooling system (which could be cryogen-based, or cryogen-free cooling systems—including those based on dilution refrigeration).

In a preferred embodiment, the orbital electrostatic trap mass spectrometer will remain an independent, fully operational mass spectrometer after integration with the System Interface and the cryogenically-cooled NEMS-MS sub-systems. The orbital electrostatic trap mass spectrometer is capable of sending and receiving ionized proteins and other biological complexes through the HCD (Higher-energy Collisional Dissociation) cell. Generally described, the orbital electrostatic trap mass spectrometer includes an ionization source for generating ions from a sample, a set of optics for delivering the ions to a quadrupole mass filter, a collision cell for generating product ions by dissociation of precursor ions selected by the quadrupole mass filter, and an orbital electrostatic trap (marketed by Thermo Fisher Scientific under the trademark "Orbitrap") for separating the precursor and/or product ions according to their mass-to-charge ratios (m/z's) and acquiring a mass spectrum representing ion abundances at different values of m/z. An ion trap formed from electrodes concavely curved toward the electrostatic trap inlet (referred to as a "c-trap"), functions to collect ions from the quadrupole mass filter or collision cell and to inject the accumulated ions into the electrostatic trap for analysis, Instruments with the foregoing architecture are commercially available from Thermo Fisher Scientific under the trademark "Q Exactive".

The System Interface is designed to enable such molecular exchanges; this is facilitated by an about 1 mm diameter ion beam that permits shuttling biomolecular ions between the orbital electrostatic trap mass spectrometer and the NEMS-array stage. Analytes are guided between the first and second mass spectral systems by ion optics in the System Interface, which includes, for examples, quadrupoles, apertures, and ion lenses. Additionally, an intermediate stack of lenses with curved ion trajectory (Z-lenses) can serve as both an electrostatic beam shutter and a neutral-species filter; the latter is especially important for minimizing unwanted contamination of the NEMS sensors.

In a preferred embodiment, the HCD cell operates at a fairly high pressure of about $10^{-4}$ Torr. The System Interface provides sequential stages of differential pumping to maintain an ultimate vacuum of $<10^{-9}$ Torr at the cryogenic end. Similarly, cooled components within the System Interface reduce thermal radiation into the fridge. The NEMS-array analysis stage houses the NEMS chips and their proximal electronics and optics, and permits computer-controlled positioning with respect to the ion beam. The cryogenic cooling system can be obtained by various manufacturers, or manufactured directly. Cooling systems working down to liquid nitrogen or liquid helium base temperatures can easily be configured to operate horizontally, simplifying the system architecture (among current, commercially-available systems are those, for example, from Janis Research.) Dilution refrigerator systems, which can be purchased commercially (e.g., from BlueFors), can also be manufactured to operate horizontally. Such dilution refrigeration systems are very similar to those typically used for modern low temperature physics studies. In various embodiments, a very small opening is installed as a custom modification to allow introduction of the ion beam into the sample stage. Such modification has been previously demonstrated [73]. The modifications can be engineered, and the heat load from the ion beam appears to be tolerable. When properly shielded, the NEMS sensors can heat slightly, to less than 20 mK from base temperature. Measurement connections for optics (fiber) and electrical (filtered low frequency, high-current, and RF cables) can be installed in the dilution refrigerator. These will provide requisite excitation, control, and readout for the NEMS arrays. The individual NEMS devices within the arrays can be actuated and detected optically and electrically. Optical interrogation involves tunable laser sources near 1550 nm, fiber couplers, phase modulators, polarizers, photodetectors, and the like. These are all subcomponents within the System Interface. As is necessary, electronic instrumentation, such as network analyzers, spectrum analyzers, signal generators and low-noise amplifiers can be used. Finally, a computer for data acquisition and instrument control can be used.

Finally, another part of the instrument is sample introduction including use of an ion source. Methods known in the art can be used for introduction of sample into the hybrid instrument, and the instrument is adapted for such introduction. Typically, the sample is introduced from the outside of the instrument which is at atmospheric pressure into a vacuum on the inside of the instrument (an atmosphere-vacuum interface is needed). Soft ionization methods can be used. For example, one method is the electrospray ionization method (ESI). Nanospray methods can be used (e.g., nESI). Static nano-electrospray ionization can be used. Gold-plated capillaries can be used. Chip-based electrospray ionization technology can be used. In addition, multi-well plate robotic loaders can be used (e.g., Advion NanoMate). Sample introduction can involve integration with other analytical methods such as chromatography. Matrix-assisted laser desorption/ionization (MALDI) can be used. Also, laser-induced liquid bead ion desorption (LILBID) can be used.

In one embodiment, the mass spectrometer is adapted for external sample introduction into the first mass spectral system and also external sample introduction into the second mass spectral system. In another embodiment, the mass spectrometer is adapted for external sample introduction into the first mass spectral system. In some cases, the second mass spectral system would not be adapted for sample introduction. In another embodiment, the mass spectrometer is adapted for external sample introduction into the second mass spectral system. In some cases, the first mass spectral system would not be adapted for sample introduction.

As used herein, the term "ion(s)" should be construed as encompassing any charged particle, the analysis of which may be effected using the NEMS-MS instrument described herein. More specifically, the term "ion" should be deemed to include very high mass charged entities (biological or otherwise) such as charged aggregates, DNAs, RNAs, and viruses, that may not be conventionally considered to constitute ions as that term is commonly used in the mass spectrometry and related arts. Once within the instrument, the sample and the ion beam can be directed in either direction between the first and second mass spectral systems. For example, the first mass spectral system can allow pre-selection of samples for analysis by the second mass spectral system, and the second mass spectral system can allow preselection of samples for analysis by the first mass spectral system.

A wide variety of samples can be introduced into and analyzed with the instruments and methods described herein including, for example, biomolecules, biomolecular complexes, and biological machines, including organelles. Samples of high molecular weight and complexity can be evaluated. Samples can be, for example, macromolecules, protein assemblies, antibody complexes, membrane proteins, intact organelles (e.g., ribosomes, proteasomes, and the like), viruses, and viral subassemblies (e.g., capsids). Samples can be peptides, proteins, nucleotides of various kinds, oligonucleotides, saccharides of various kinds, oligosaccharides, and metabolomic molecules.

Sample molecular weight can be, for example, low molecular weight or high molecular weight such as, for example, 100 kDa to 100 MDa, or even higher, such as, for example, 100 kDa to 500 MDa. The size of a molecular sample can be, for example, 1 nm to 100 nm in diameter. See, for example, J. Snijder and A. Heck, "Analytical Approaches for Size and Mass Analysis of Large Protein Assemblies," *Annu. Rev. Anal. Chem.* 2014, 7; 43-64.

Of course, the instrument can be controlled with computer hardware and software, including user interfaces, as known in the art.

Methods known in the art can be used to assemble the instrument. The working examples, for example, describe and illustrate various parts of the assembly.

Methods of Using Hybrid Instruments

Also provided, of course, are methods of using the instrument described herein. In particular, a method is provided wherein a sample is introduced into the apparatus and subjected to analysis in the first and/or second mass spectral systems. In many cases, analysis using both mass spectral systems is desired to provide the benefits of integration. However, the instrument also can be adapted and used in which only one of the two mass spectral systems are used.

In one embodiment, the sample is subjected to analysis in the first and second mass spectral systems in parallel. In another embodiment, the sample is subjected to analysis in the first and second mass spectral systems sequentially.

In one embodiment, the sample is subjected to analysis in the first and second mass spectral systems in parallel in full mass range mode. In another embodiment, the sample is subjected to analysis in the first and second mass spectral systems in parallel with a mass filter stepping through different m/z ratios.

In one embodiment, the sample is subjected to fragmentation. In one embodiment, the method is used to measure degree of solvation.

In one embodiment, the sample is subjected to additional analysis while present on a resonator of the NEMS-MS system.

In one embodiment, the analysis with the instrument includes single molecule analysis.

In one embodiment, the analysis with the instrument is native single molecule analysis.

In one embodiment, the sample is introduced at native conditions.

In one embodiment, the analysis includes inertial imaging.

In one embodiment, the sample is a heterogeneous sample and heterogeneous physisorption occurs onto a NEMS array such that coverage is ≤1 complex per NEMS pixel. In another embodiment, the sample is a heterogeneous sample and heterogeneous physisorption occurs onto a NEMS array such that coverage is ≤1 complex per NEMS pixel.

In one embodiment, the sample is a heterogeneous sample and heterogeneous physisorption occurs onto a NEMS array such that coverage is ≤1 complex per NEMS pixel, wherein each adsorbed species is subjected to analysis.

In one embodiment, the sample is a heterogeneous sample and heterogeneous physisorption occurs onto a NEMS array such that coverage is >1 complex per NEMS pixel, wherein subsequent mechanically based inertial imaging of shape is employed to recognize the multiplicity of adsorbed species, and provide their separate characterization.

In one embodiment, the sample is a heterogeneous sample and heterogeneous physisorption occurs onto a NEMS array such that coverage is ≤1 complex per NEMS pixel, wherein each adsorbed species is subjected to programmed desorption followed by further analysis of the desorbed species. More particularly, a four step process can be described for programmed desorption. A first step includes injection (e.g., by electrospray injection) of a heterogeneous sample into the hybrid system with analyte ionization. A second step includes heterogeneous physisorption onto a NEMS array of the first mass spectral system, wherein coverage is one or fewer complexes per NEMS pixel. A third step includes identification and stratification of each adsorbed species by analysis while on the NEMS array, in which some complexes can be selected for desorption before others. A fourth step provides for sequential programmed desorption of stratified molecular species followed by further analysis, including possible dissociative analysis, in the second mass spectral system.

Further description for the method of use is provided with respect to FIGS. 1A and 1B which show a preferred embodiment. In FIG. 1B, ions are produced by a nanospray source at atmospheric pressure preferably at native conditions, get transported through atmosphere-to-vacuum interface into vacuum, optionally mass selected by quadrupole mass filter, and then a spectrum is acquired by mass spectrometer as known in the art. In this case, an orbital electrostatic trap mass spectrometer is used but other types like time-of-flight (TOF), open or closed electrostatic traps (EST), Fourier transform ion cyclotron resonance (FT ICR) instruments could be used. Molecular mass of the analyte may be determined from the mass spectrum (which, as noted before, records the ion intensity as a function of mass-to-charge ratio), in some cases, by standard charge state deconvolution techniques available in the mass spectrometry art.

Deconvolution becomes complicated when charge distributions of several similar in mass species overlap, especially when intensities differ by an order of magnitude or more. Examples of such samples are antibody aggregates (mixture of n-mers where n=1, 2, 3, . . . ) or heterogeneous virus capsids (genetically or due to differences in viral cargo as shown in e.g. J. Snijder et al, "Defining the Stoichiometry and Cargo Load of Viral and Bacterial Nanoparticles by Orbitrap Mass Spectrometry". *J. Am. Chem. Soc.,* 2014, 136 (20), pp 7295-7299. DOI: 10.1021/ja502616y. For such complicated but typical cases, histograms of analyte masses can be collected on NEMS device or array of such devices in parallel or sequentially with mass spectrum on mass spectrometer. Peaks from NEMS histograms can be used as the first approximation for fitting the mass spectra to reduce ambiguity of peak assignment. Such parallel acquisition could be done either in full mass range mode or with quadrupole mass filter stepping through different m/z ratios. While MS would show just one peak, NEMS would acquire a histogram which might have different masses corresponding to the selected m/z. By scanning through the mass range of interest, even small components can be deconvoluted and quantitated. In addition to the histogram approach described above, other suitable statistical methods may be utilized to identify the most probable molecular mass for fitting the mass spectra from one or more measurements acquired using NEMS.

Also, the NEMS device can be also used to measure fragments of analyte molecules, with fragmentation implemented by, for example, collisions with gas in the collision cell, electron- or ion-facilitated methods like electron capture dissociation, electron ionization dissociation, electron transfer dissociation and others, or by photodissociation under any wavelength, e.g. IR or UV. One of major problems for heavy analytes is quality of desolvation as in many cases even after energetic collisions in the source and collision cell, some molecules of solvent and alkali ions remain adsorbed to the analyte. In this respect, NEMS presents opportunity for the strongest desolvation possible, e.g., by accelerating analyte ions by 100s or even 1000s of Volts and impinging them on the resonator surface. While analyte ion is likely to get fragmented, it would be the weakest bound ligands that will break off first and are more likely to be transferred into gas phase, thus leaving behind analyte alone and allowing to measure its "dry" mass. Comparison between this "dry" mass and mass measured by MS allows to correct mass measurements by MS and establish degree of solvation.

One embodiment relates to data-dependent pixel-by-pixel desorption. Within the same apparatus, a more advanced method involves reading back data from an integrated NEMS array containing, for example, $10^1$-$10^6$ NEMS resonators (or perhaps more) operating in concert. As it was shown in prior art, detection by each of the resonators could be done on millisecond or sub-millisecond time scales. To load less than one ion per NEMS resonator, the incoming ion beam can be scanned by electrical lens to spread ions over the entire surface of NEMS array.

Ions can be deposited on resonator in a so-called "soft landing" mode so that their fragmentation is avoided (preferably, following acceleration of not more than 20-100 V) and they become only weakly bound to the surface. The outcome of an ion-surface interaction event depends on, for example, the analyte's structure and stability, the properties of the surface, and its incident momentum. Isolating coating thickness is chosen to minimize electron transfer to the underlying surface or device during the time duration that ions reside on it and to avoid substantial neutralization of ion charge. Preferably, self-assembled monolayers (SAMs) or halogen-rich films can be used as such isolating coatings. Examples are SAMS consisting of decanethiol terminated with $CF_3$ (FSAM), $CH_3$ (HSAM), and the like. The coating can also help control the adhesion energy for desorption.

Following detection (preferably, on a millisecond or sub-millisecond time scale), a set of identical high-mass, intact species of interest can be identified out of the entire heterogeneous collection of all ions on NEMS array. These preselected identical and still charged species can be then programmatically desorbed from the NEMS surfaces simultaneously, in quantities large enough to exceed the detection threshold required for subsequent top-down MS analysis such as with use of orbital electrostatic trap MS. Optionally, they are then transported back into the collision cell and can be subjected to subsequent higher-energy collision induced dissociation (HCD) or other fragmentation methods followed by top-down MS analysis.

Any known local (pixel-by-pixel) desorption method or combination thereof can be employed. For example, laser-induced desorption (including such methods as laser-induced acoustic desorption, LIAD) or electrostatic desorption using existing connections to a resonator and/or electric heating can be used. Alternatively, methods employing ultrasound can be utilized.

Additional embodiments for use of the instrument are described in provisional application 62/107,254 and are described more hereinbelow, including cited references.

Native Mass Spectrometry and Single-Molecule, Native Mass Spectrometry of Protein Complexes.

Native mass spectrometry is an important application of the instruments and methods described herein. Most biological processes involve regulated cooperation, both spatially and temporally, between a multiplicity of molecular partners. More specifically, proteins interact with numerous molecular entities—including other proteins, nucleic acids, and small-molecule ligands—to form functional molecular complexes. Studies of protein complexes, and networks of interacting proteins, are assuming increasing importance in the life sciences, as is characterizing protein interactions with nucleic acids, cofactors, and messenger molecules. Attaining a molecular-level understanding of biological processes first involves structural and functional characterization of the subcomponents making up such complexes and then understanding how they interact together to achieve key biological functions in the overall assemblage. Of course, such molecular complexes are not generally static; they are in constant flux, and their subcomponents may be exchanged dynamically during biological activity [15].

In this context, the field of "native" mass spectrometry (Native MS) has emerged. Its focus is upon measurement of intact proteins and protein complexes from non-denaturing solutions—that is, from preparations that largely preserve their native conformation and functionality [15]. "Native mass spectrometry is an emerging technology that allows the topological investigation of intact protein complexes with high sensitivity and a theoretically unrestricted mass range. This unique tool provides complementary information to established technologies in structural biology, and also provides a link to high-throughput interactomics studies, which do not themselves generate information on exact protein complex-composition, structure or dynamics." [16]

Achieving the goals of Native MS, however, is not necessarily straightforward; protein complexes assemble with a high proportion of non-covalent interactions. Yet, despite their ostensible lability, protein complexes with masses >1 MDa have been measured successfully by Native MS—that is, from the gas phase. To achieve meaningful results from Native MS, however, very careful sample preparation (often including measures to stabilize weakly associated complexes) and gentle analysis conditions (to minimize complex fragmentation) are key.

The applications of Native MS are vast, and many such applications can be linked to the methods and instruments described herein. For example, it has been used as a tool for screening small molecule compound mixtures to identify low-to-medium affinity ligands [17, 18]. Screening millions of interacting compounds to target specific proteins is critical to development of new pharmaceuticals. These can involve antibody isoforms with masses exceeding 1 MDa. Native MS can also provide information about topology and dynamics that is important for structural biology; for example, the locations and nature of ligand binding sites [19-22], and information about membrane protein complexes [23].

By contrast, topdown MS in the prior art, which involves molecular dissociation and subsequent analysis of the resulting molecular fragments, can generate sequence and identity information for monomeric proteins, but provides limited applicability for analyzing large, noncovalent protein complexes. In part, this limitation is instrumental: measurement of large (greater than 100 kDa) protein complexes is difficult with conventional MS systems.

However, existing MS systems also typically do not have sufficient sensitivity to resolve individual protein complexes, so purification to create a homogeneous population of analytes is needed. Otherwise, the analysis of samples of requisite size for typical experiments will invariably contain heterogeneous populations of protein complexes; these will yield an "average" over differently assembled complexes—conflating, rather than stratifying, the variety of species present within the sample.

Ion Mobility Spectrometry

Ion mobility spectrometry (IMS) can be integrated into the methods and instruments described herein. IMS is an analytical technique used to separate and identify ionized molecules in the gas phase based on their mobility in a carrier buffer gas. The separation mechanism, involving collisions with the background gas, differentiates analytes by their (rotationally averaged) collisional cross-sections. When coupled with mass spectrometric analysis, IMS provides an additional level of information that enhances characterization of biomolecular species—especially in the case of high-mass macromolecular complexes. For example, ligand binding to biomolecular complexes can sometimes induce conformational changes that affect the collisional cross section of the complex, and these changes can be monitored via ion mobility measurements [24]. IMS can also be used to monitor changes in the stability of a complex upon ligand binding. To facilitate this, ions are stored in an ion trapping region where they undergo ion activation (e.g. heating) which acts to destabilize the complex and increase the ion mobility drift time; ligand binding can reduce this effect as a result of increased stability [15]. In both cases, IMS is useful for monitoring or discovering complex-ligand interactions that occur when the complex is in its native state; such information could not be obtained otherwise.

Single-Molecule Nanomechanical Mass Spectrometry:

Over the last decade, mass measurements using nanomechanical devices have been systematically improved to the point where they now offer capability for a new form of mass spectrometry. NEMS resonators are extremely sensitive to the added mass of adsorbed particles [25-30], and this has led to advances including mass detection of individual proteins [4,31], nanoparticles [32], large biomolecules [33, 34] and individual atoms [35-38]. Results are described in the prior art outlining capabilities for performing single-protein mass spectrometry using NEMS-based experimental systems (see [4]).

In the experimental approach developed, a NEMS device or array of devices is placed in a vacuum chamber, cooled below ambient temperature, and its frequencies are continuously tracked with a sensitive electronic (phase-locked) control loop [4]. Using methods from conventional mass spectrometry, biomolecules are delivered sequentially to the NEMS device, and the induced frequency shifts arising from single-molecule events are measured for two modes and used to deduce the adsorbing analyte's mass and position [4]. Cooling the NEMS enhances non-specific physisorption of the arriving analytes on the surface of the device(s). FIG. 1a of provisional application 62/107,254 shows example raw data of time-correlated frequency shifts induced in the first two displacement mechanical modes of a NEMS resonator by single-molecule events.

By individually measuring the mass of sequentially arriving particles, a mass spectrum representing the entire heterogeneous sample can be constructed, as seen in FIG. 1b of provisional 62/107,254. Here, each IgM molecule landing on the device appears as a Gaussian-like mass distribution. As subsequent molecules land on the device, the mass spectrum for each molecule can be added together if desired, to form a composite spectrum representing the entire sample (FIG. 1b of provisional 62/107,254, black curve)—but NEMS-MS resolves its intrinsic components.

Over the past decade, several experimental systems have been constructed for performing NEMS-based mass spectrometry. One tabletop system, used to acquire the IgM data shown in FIG. 1 of provisional 62/107,254, employs electrospray ionization (ESI) and ion optics to guide individual analyte ions onto the NEMS sensor(s). The setup consists of an ESI system to launch protein ions into three successive, differentially pumped vacuum chambers. The analytes are transported along their trajectory by hexapole ion guides, and ultimately delivered to the NEMS analysis stage. A flow cryostat is used to cool this stage to stabilize analyte physisorption onto the NEMS sensors. Complete system details can be found in [4].

Single Molecule Inertial Imaging

Figure 2:
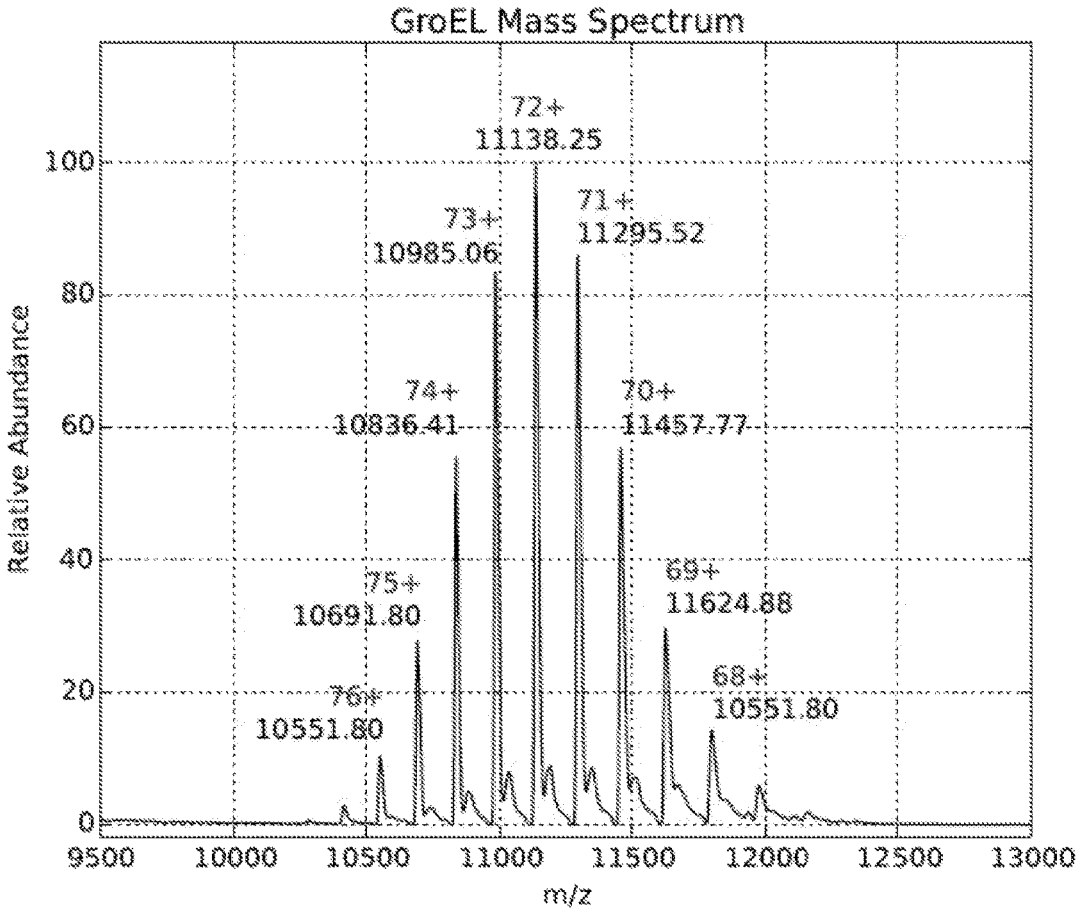
FIG. 2 illustrates m/z spectrum of GroEL ions observed in the orbital electrostatic trap analyzer shown in FIGS. 1A and 1B. Charge states were assigned in order to minimize the standard deviation of the calculated mass. Calculated mass was 801,105 Da, confirming that intact GroEL complexes could be transferred within the system.

Inertial imaging is somewhat analogous to IMS, but provides the enhanced capabilities of single-molecule analysis without rotational averaging. Inertial imaging is a new NEMS-based technique recently developed, which provides the spatial distribution of mass within an individual analyte—in real time and with molecular-scale resolution—when it adsorbs onto a nanomechanical resonator [39]. By continuously monitoring of multiple vibrational modes of a nanomechanical device, the spatial moments of mass distribution can be deduced for individual analytes, one-by-one, as they adsorb. Inertial imaging has been validated with experimentally acquired multimode frequency-shift data and by finite-element simulations—to permit analysis of the inertial mass, position-of-adsorption, and the molecular shape of individual analytes [39]. Details of the mathematical formalism underlying inertial imaging can be found in [39]. In brief, when an analyte lands on a nanomechanical resonator, each of its vibrational modes frequency shifts differently in response to the attached (minute) "load." An ensemble of these distinct modal frequency shifts can then be used to yield moments of the analyte's mass density distribution; to deduce N moments requires measuring induced shifts in a minimum of $N_{+}1$ modes. The method is termed inertial imaging as it enables reconstruction of the analyte's spatial mass density from the deduced moments—e.g., by employing a Pearson distribution method [40] (FIG. 2 of provisional 62/107,254).

NEMS Arrays Enable Absorptive Sequestration and Identification of Intact, Large-Mass Species.

By specially preparing the surfaces of NEMS mass sensing pixels, "soft landing" physisorption (described below) are enabled. These special surfaces preserve the charge state and molecular configuration of the analytes—while permitting single-molecule mass measurements and inertial imaging. The incoming molecular beam flux can be adjusted to allow at most one analyte to land per pixel. Physisorption of these individual analytes (i.e., sequestering them upon individual pixels) can be assured, as the ambient temperature of the pixels will be much lower than the effective temperature of the incoming beam, and the analyte momentum can be adjusted to be just sufficient to overcome surface potential barriers. The NEMS array thus can be used to sequester and then characterize individual molecules.

Once loaded, individual pixels can be programmatically unloaded. This permits analyte-specific "preconcentration" from specific sub-populations ("strata") of an originally heterogeneous sample, to achieve quantities sufficient to exceed the, for example, orbital electrostatic trap MS detection threshold (from a few, to ten or more, individual analytes).

"Soft Landing" Technology Preserves Intact Adsorbates

A new hybrid form of single molecule NEMS-MS analysis is described herein concatenated with, in a preferred embodiment, top-down orbital electrostatic trap MS. Achieving this involves the deposition of large biomolecular complexes onto solid surfaces while preserving their structure and charge state. Deposition of species at low translational kinetic energies (<100 eV)—spanning from the thermal to the hyperthermal regimes (see FIG. 3 of U.S. Provisional 62/107,254 and Reference 5)—can lead to three competing processes: (i) dissociative landing, during which the analyte fragments and its components are retained on the surface; (ii) reactive landing, in which covalent or strong electrostatic bonds are formed between the ion and the surface; and (iii) soft landing, in which the species lands and remains intact while becoming weakly bound to the surface [47]. The precise outcome of an ion-surface interaction event depends on the molecule's structure and stability, the properties of the surface, and its incident momentum [47]. While small molecules (about 100 Da) often demonstrate dissociation below 10 eV [48], studies report the intact landing of very large complexes, which are apparently able to absorb collisional energy internally given their large number of internal degrees-of-freedom. Examples include rice yellow mottle virus and tobacco mosaic virus (62 and 40 MDa, respectively) [49], various enzymes including lysozyme trypsin [50], and the protein complexes GroEL and apoferritin (800 kDa and 440 kDa) [51]. In these studies, intact landing proved to be robust—with viruses retaining their infectivity, and enzymes their function upon rehydration; GroEL and apoferritin were observed to retain their structure, roughly independent of their translational kinetic energy prior to collision.

Among intact landing processes, reactive landing occurs when the functional group on the ion interacts with a terminal group on a functionalized surface [52]; however, if specific reactive functional groups are absent, the adsorbed analytes will be only weakly bound and thus can be categorized as having experienced soft landing. Soft landing events can be further categorized depending on whether the ions are neutralized or retain their charge upon colliding with the surface.

Analyte charge neutralization is the dominant process that occurs for analyte adsorption onto clean, conducting substrates. Conversely, charge retention can be promoted by pre-coating such substrates with thin, electronically-inert organic films [53].

Common films in this category include, for example, self-assembled monolayers (SAMs), consisting of decanethiol terminated with $CF_3$ (FSAM), $CH_3$ (HSAM), or COOH (CSAM). The degree of charge retention depends strongly on the particular film employed and the incoming analyte's kinetic energy. When positive ions are collide upon treated surfaces, FSAMs efficiently retains charge, HSAMs weakly retains charge, and CSAMs completely neutralizes charge [54]. Due to its efficacy, FSAMs have been used to demonstrate charge retention following the soft landing of a variety of (positively charged) molecular ions, from small polyatomic compounds [48, 55] to polypeptides [54].

For singly protonated peptides, charge retention is extremely stable upon soft landing upon an FSAM modified surface; however a small fraction of charged peptides are instantly neutralized when interacting with the surface, the charge associated with the remaining ions leaves the surface only during slow thermal desorption of the peptides [56]. Multiply protonated peptides exhibit internal Coulomb repulsion, and this promotes additional charge decay via the exchange of some of the protons with the SAM; however, charge retention remains robust over short timeframes, as the process of proton exchange has a time constant of several hours [56].

Programmed Desorption of Pre-Selected "Strata" within Heterogeneous Samples

By controlling ion flux, one can load pixels in the NEMS array with at most one analyte. This will permit accumulation and identification of an ensemble of high-mass, intact species. Subsequently, preselected aliquots of identical species from this heterogeneous collection can be programmatically desorbed from the NEMS surfaces simultaneously, in quantities large enough to exceed the detection threshold required for, for example, subsequent topdown orbital electrostatic trap MS. This preselection process involves, first, single-analyte "soft landing" adsorption onto individual mass sensing pixels, followed by programmed desorption of a small ensemble of "identical" molecules, then transport back into the HCD cell for subsequent collision induced dissociation (CID) and top-down orbital electrostatic trap-MS analysis.

A combination of desorption methods can be employed and optimized. Significant success has been had in the past applying laser-induced acoustic desorption (LIAD) for NEMS-MS desorption via a rastered UV laser beam [57]. Additional approaches to induce controlled (programmable) desorption of the charged analyte will involve new NEMS device implementations that permit local (pixel-by-pixel) electrostatic desorption and heating.

It is important to note that, in effect, the automated pre-selection protocol replaces purification protocols for heterogeneous samples—which are developed by laborious, and time-intensive manual protocols for each specific molecular target. Here they are automated by single-molecule measurements and subsequent selection. This approach is well adapted to stratifying sparse and precious samples. This embodiment is essentially a single-molecule variant of recent techniques for preparatory mass spectrometry.

Subsequent Dissociative Analysis Via the Orbital Electrostatic Trap HCD Cell (as Second Mass Spectral System)

Desorbed, now-homogeneous sample aliquots can be transported by ion optics back into the second mass spectral system (e.g., the orbital electrostatic trap system as shown in the working examples), where dissociative, top-down proteomics can be performed on individual strata of large-molecular-weight species within the sample population. Top-down, post-NEMS proteomic profiling can be carried out, either using the intrinsic capabilities of the orbital electrostatic trap system for CID, or by modifying the new hybrid system to enable surface induced dissociation (SID) prior to orbital electrostatic trap MS. SID has recently proven to be very effective for fragmenting high mass complexes and species [58]. Hence, methods such as SID, CID, and UV photodissociation (UVPD) can be used to analyze the sample. Protein sequencing can be carried out as part of sample analysis.

The overall protocol that is outlined above circumvents a principal objection raised against Native MS—its tendency, in conventional realizations, to average over heterogeneous sample populations. The number of species delivered can be adjusted to exceed the detection threshold for orbital electrostatic trap analysis (typically, about 3 to tens of high-mass entities). It should be noted that the orbital electrostic trap instrument itself is specially modified to permit analysis of m/z ratios up to about 40,000 and is capable of achieving single molecule sensitivity for multiply charged ions. With typical ESI generated charge states of about 100e− for high-mass species, the analysis range for intact species is about 4 MDa [59, 60]. NEMS, by contrast, has single-molecule sensitivity, and provides vastly enhanced upper mass range, ultimately limited to many GDa only by the requirement that an analyte must be accommodated within the physical dimensions of the mass-sensing pixel itself. It should also be noted that the NEMS pixels themselves can be configured to separately measure the charge of adsorbed species—in addition to measuring their total mass and acquiring their inertial image. In previous work, it was demonstrated the capabilities of NEMS-based electrometers to provide sub-single electron charge detection sensitivity [61].

Four Specific Applications:

Some additional, representative, but specific applications include, for example, (1) obtaining detailed structural information of many virus capsids and their assembly processes; (2) a novel method for label-free and rapid assessment of antibiotic susceptibility, (3) study of Trop2 surface protein; and (4) investigations of membrane protein conformational changes resulting from drug binding.

Application 1.

Detailed structural information of many virus capsids exists, but less is known about their assembly processes because of their inherent heterogeneity and complexity of typical samples. For example, the packaging motor within the T4 bacteriophage consists of the dodecameric portal protein gp20, along with the small and large terminase proteins gp16 and gp17 [1]. When purified, gp16 is randomly degraded into gp169-164. At this stage, both gp16 and gp169-164 are capable of oligomerizing with gp17, and this leads to significant heterogeneity that, because of multiply overlapping charge states, prevents the deconvolution of a typically acquired m/z spectrum. Therefore, detailed analysis of the assembly process, such as determining the stoichiometry of gp17, is impossible with present techniques [2]. Partial protein degradation is common in the intermediate stages of virus assembly; for example, it is also observed via peak splitting in the incorporation of tail factor gp4 with the gp1 portal complex in P22 bacteriophage [3]. NEMS-MS greatly improves resolution for such experiments as it is not charge sensitive (will not have overlapping charge peaks), and has high resolving power for high-mass species.

Application 2.

Almost half of known antibiotics target the bacterial ribosome; they function by preventing translation of new ribosomal proteins [7]. This results in the accumulation of smaller, incompletely assembled precursor units that differ in mass from fully assembled units by 150-200 kDa [8]. Electron microscopy shows that these precursor units are highly heterogeneous [8]. This generally obfuscates mass deconvolution via native MS. However, as NEMS analysis is based solely on the inertial mass of analytes, single-molecule NEMS-MS is capable of analyzing these complexes directly. A novel method for label-free and rapid assessment of antibiotic susceptibility can be provided.

Application 3.

Trop2 is a surface protein that has been implicated in several carcinomas [9-14]. Specifically, Trop2 induces a cancerous phenotype via regulated intramembrane proteolysis (RIP), in which the membrane protein is cleaved within its transmembrane domain to yield an intracellular protein fragment that targets further cell signaling networks [41-43] that induce cancer. However, the ultimate fates of both the ectodomain and intracellular fragments of Trop2 as well as their composition, remain open questions. Trop2 is a specific example of the variety of membrane proteins that are important for cell-signaling and regulatory processes involved in cancer pathogenesis [44]. This class of proteins has been particularly difficult to study using conventional mass spectrometry because of interference from lipids with high ionization efficiency [16]. One can provide samples for measurement, including very small quantities obtained from specific cells localized within tumors. One can measure purified Trop2 samples (both whole and fragmented) to characterize their structural sub-components. One can also analyze Trop2 from serum to determine other complexes that may bind to it and their pathways for decomposition. These measurements can inform the use of Trop2 fragments as potential biomarkers for diagnosis or therapies.

Application 4.

In addition to enabling intact mass measurements, inertial imaging can enable the compilation of size spectra, yielding far more information than a rotationally-averaged collision cross section obtained from ion mobility measurements. This technique can be used, for example, in investigations of membrane protein conformational changes resulting from drug binding. As an example, the (ATP)-binding cassette (ABC) membrane transporter P-glycoprotein (P-gp) nonspecifically pumps xenotoxins out of the cell and has been implicated in the acquisition of multidrug resistance in chemotherapy treatments [45]. Ion mobility measurements show that upon binding with cyclosporine A and ATP, the equilibrium between two conformations of P-gp shifts; this offers a route for monitoring the effects of drug binding [46]. However, the high collision energy required to strip lipids from these complexes via IMS severely reduces its resolution, and current instrumentation only permits determination of major conformational changes on the order of 10% of the average collision cross section [24]. Previous measurements have been achieved by native MS and ion mobility IMS, but only a few major conformational changes can be resolved using existing instrumentation [46]. NEMS inertial imaging by contrast with IMS—which provides a rotationally averaged collision cross section (CCS)—provides shape analysis of individual molecules. This provides non-averaged information directly to elucidate the distribution of molecular sizes—to yield a more detailed picture of the conformational changes that occur.

Table 1 provides examples of macromolecular targets.

TABLE I

Examples of macromolecular targets

| Mass | Required Resolution | Complex | Application | Ref. |
|---|---|---|---|---|
| 10-50 MDa | 1 MDa | Viruses | Intermediate structural stages during bacteriophage capsid assembly | [1-3] |
| 3 MDa | 150 kDa | Ribosomes | Detection of antibiotic susceptibility via partial subunit assembly | [7, 8] |
| 800 kDa | 10 kDa | GroEL | Chaperonin-assisted protein folding | [2] |
| 50 kDa | 1 kDa | Trop2 | Regulated intermembrane proteolysis | [9-14] |

Applications of Instruments and Methods

The instruments and methods of use can find many applications. Analytical applications of mass spectrometry are wide spread and many of them can be targeted with the instruments and methods described herein. Examples of applications include biochemical and life science applications including, for example, proteomics, metabolome, high throughput in drug discovery and metabolism. Other examples include pollution control, food control, forensic science, and natural products or process monitoring. Still other applications include atomic physics, reaction physics, reaction kinetics, geochronology, inorganic chemical analysis, ion-molecule reactions, and determination of thermodynamic parameters.

ADDITIONAL EMBODIMENTS

In some cases, methods described herein can also be carried out with an instrument comprising the first mass spectral system (based on NEMS-MS, using micro-mechanical and/or nano-mechanical resonators) but which does not have the second mass spectral system. For example, desorption, programmed desorption, or pixel-by-pixel desorption could be carried out with only the first NEMS mass spectral system. Hence, for example, an embodiment is provided in which a sample is subjected to NEMS-MS analysis by adsorption of the sample to the resonator of the NEMS-MS system, but then the sample is desorbed from the resonator. The desorption can be part of a programmed desorption or a pixel-by-pixel desorption. The sample can be adsorbed to the resonator via a soft landing. The resonator can be part of a chip, such as a NEMS chip, and can be part of an array of resonators.

WORKING EXAMPLES

Additional embodiments are provided in the following non-limiting working examples.

Example 1: Construction of Hybrid Instrument

A hybrid instrument was built as shown schematically in FIGS. 1A and 16. Use of this instrument is demonstrated more in Example 2.

The hybrid instrument in FIGS. 1A and 16 has one system which includes an orbital electrostatic trap mass spectrometer (a second mass spectral system). This part of the instrument was a Q-Exactive Plus EMR (extended mass range) mass spectrometer obtained from Thermo Fisher Scientific, Inc. The Q-Exactive instrument was then adapted to be integrated with a custom-built NEMS-MS system (a first mass spectral system), with integration occurring through an integration zone using the HCD Collision cell of the Q-Exactive instrument. Ion optical elements were provided, and the integration zone was adapted so that the ion beam can be directed to the first and/or the second mass spectral system by electrically switching the ion optical elements. The HCD Collision cell can be used as an electrical directional device for electrical switching.

The instrument was constructed by building the integration zone and NEMS-MS system (the first mass spectral system) off of the HCD cell of the second mass spectral system. Elements used included a transfer chamber, a gate valve, a NEMS chamber, an ion lens, a NEMS stage, and a LHe cryostat. The gate valve was positioned between two quadrupoles. The NEMS stage was controlled with an xyz positioned. External mounts were used to support the system. Ion transmission rates were measured.

For the NEMS-MS part of FIGS. 1A and 1B, devices were fabricated on a 200 mm SOI wafer with VLSI processes. Electrostatic actuation and piezoresistive motion transduction were used. Molecular adsorption on a resonant beam induces a frequency shift according to the following equation:

$$\Delta_n \equiv \frac{\omega_n - \omega_n^{(0)}}{\omega_n^{(0)}} = -\frac{1}{2}\frac{\int_{\Omega_s} \mu|\Phi_n|^2 dS}{\int_{\Omega} \rho_{device}|\Phi_n|^2 dV},$$

where n is the nth resonant mode, μ is the areal mass density of the molecule, and $\phi_n$ are the mode shapes. This equation can be inverted to solve for $m^{(k)}$, the areal mass moments of the molecule (mass, position, diameter, skew, kurtosis, etc.). For details, see Hanay et al., "Inertial Imaging with Nanomechanical Systems," *Nat. Nano*, Vol. 10, 339-344, April 2015.

Cryogenics and Sensing:

For the instrument shown in FIGS. 1A and 1B, wirebonds formed electrical connections between the NEMS chip and a custom pcb. This pcb was mounted on an XYZ cryopositioner (Attocube) with subnanometer positioning resolution. Flexible copper cables were used to electrically connect the NEMS pcb to cooling pcbs which were attached to a copper sample mount in thermal contact with the 4K cryostat. Stainless steel cables were then used to carry rf signals from the cooling pcbs to feed-throughs on cryostat breakout boxes.

Figure 7:
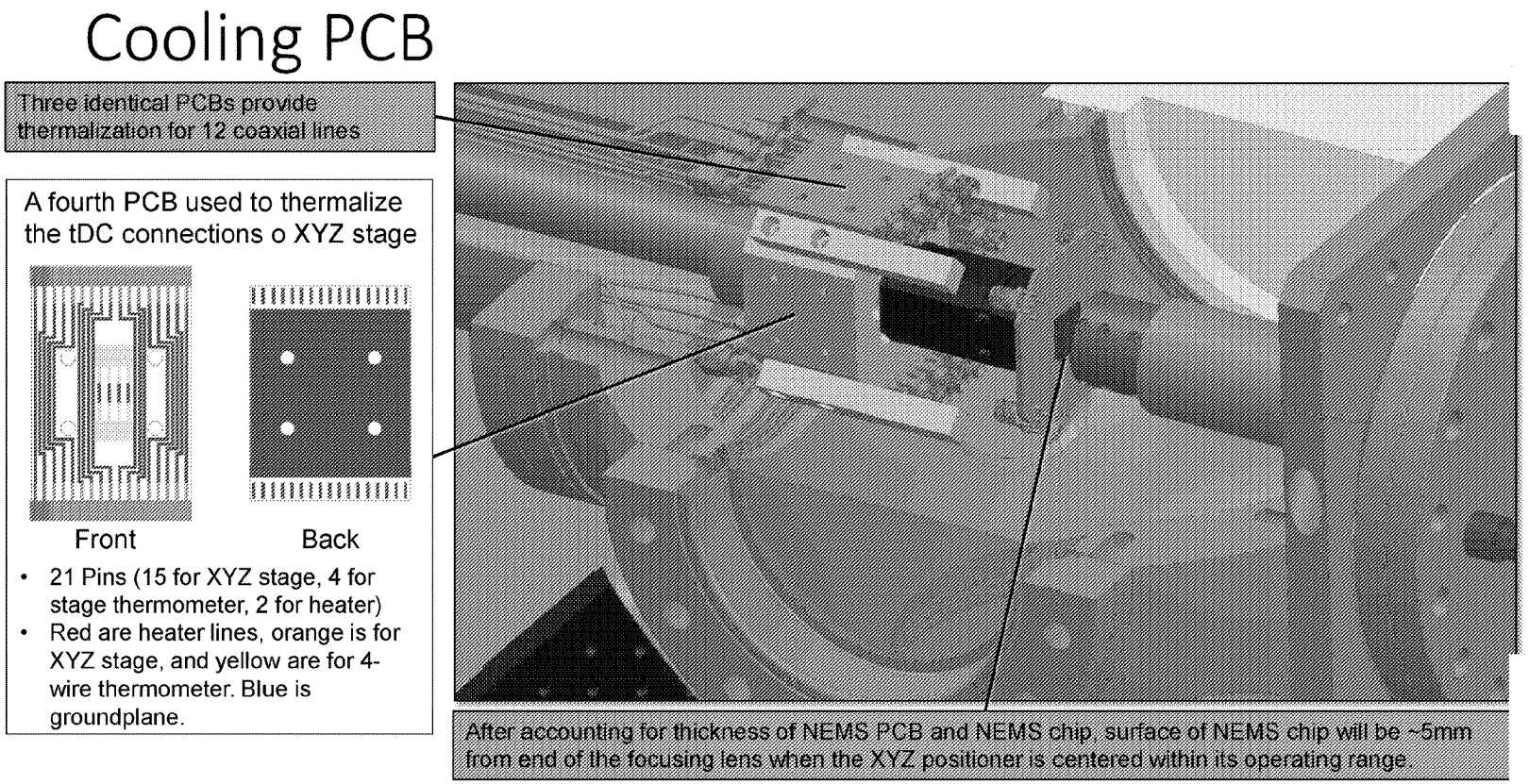
FIG. 7 shows cooling the PCB.

FIG. 7 shows cooling the PCB. On the right, as shown, three identical PCBs provide thermalization for 12 coaxial lines. Also, after accounting for thickness of NEMS PCB and NEMS chip, surface of NEMS chip will be about 5 mm from end of the focusing lens when the XYZ positioner is centered within its operating range. Also shown is an expanded view of a fourth PCB (front and back views) used to thermalize the tDC connections of XYZ stage. Twentyone pins are used (15 for XYZ stage, 4 for stage thermometer, 2 for heater); red are heater lines, orange is for XYZ stage, and yellow are for 4-wire thermometer. Blue is groundplane.

Example 2: Use of the Hybrid Instrument

In a test of the instrument of FIGS. 1A and 1B (Example 1), *E. Coli* GroEL, a 14-mer bacterial chaperonin (Rose et al., "High Sensitivity Orbitrap mass analysis of intact macromolecular assemblies," *Nature Methods,* 9, 11, 1084, November 2012), was donated and used to demonstrate system functionality. The ions were delivered to the orbital electrostatic trap mass spectrometer first but, in principle, can be delivered either to the orbital electrostatic trap analyzer or to the NEMS chamber. Needles for nanospray were used. Data generated with use of the hybrid instrument are shown in FIGS. 2-5.

FIG. 2 illustrates m/z spectrum of GroEL ions observed in the orbital electrostatic trap analyzer shown in FIGS. 1A and 1B. Charge states were assigned in order to minimize the standard deviation of the calculated mass. Calculated mass was 801,105 Da, confirming that intact GroEL complexes could be transferred within the system.

Figure 3:
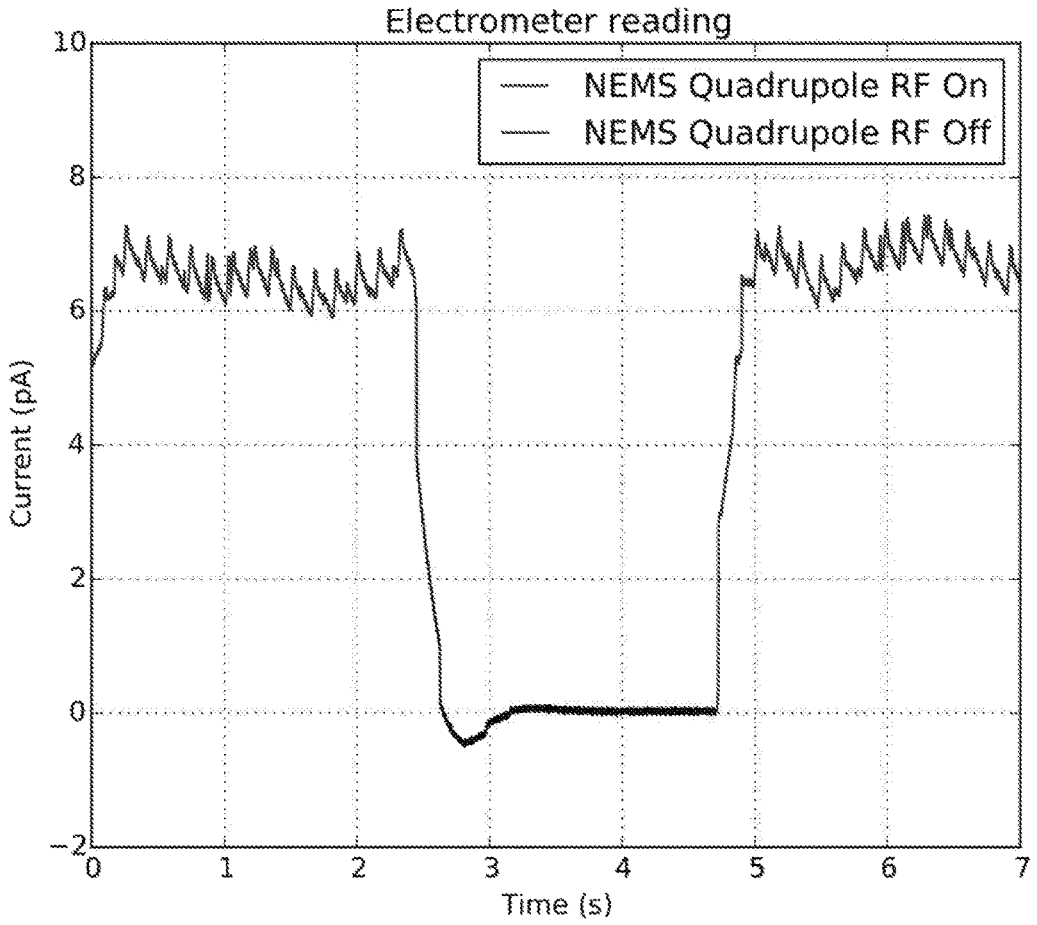
FIG. 3 shows GroEL ions were detected with a custom made electrometer (not shown) mounted on the XYZ positioner in the NEMS chamber shown in FIGS. 1A and 1B. Ions can be transmitted or blocked by turning on or off the transfer quadrupole rf.

FIG. 3 shows GroEL ions were detected with a custom made electrometer (not shown) mounted on the XYZ positioner in the NEMS chamber shown in FIGS. 1A and 1B. Ions can be transmitted or blocked by turning on or off the transfer quadrupole rf.

Figure 4:
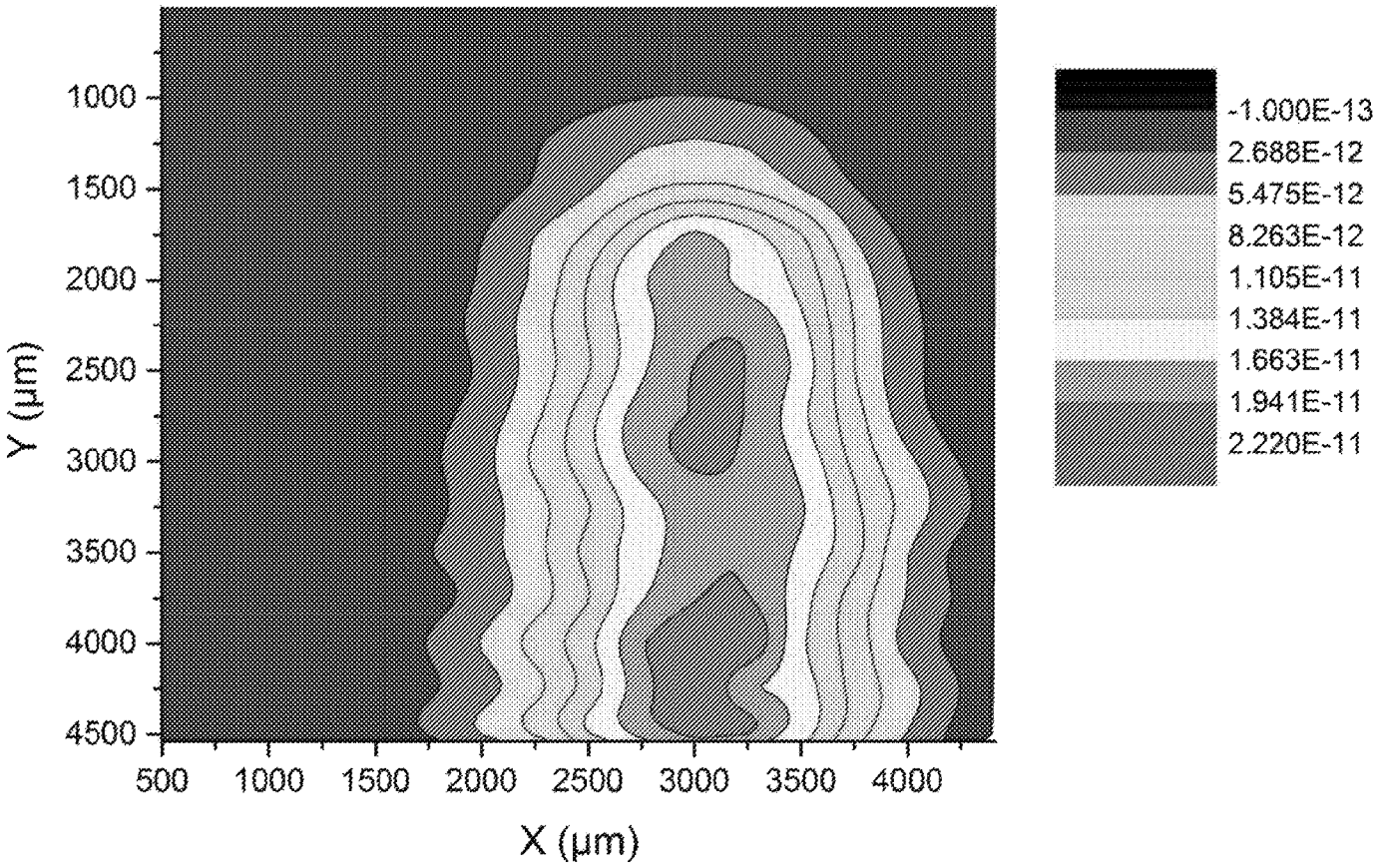
FIG. 4 illustrates the XYZ positioner was scanned to determine the position of maximum beam intensity for the instrument shown in FIGS. 1A and 1B. The non-circular appearance of the countours is due to the electrode geometry.

FIG. 4 illustrates the XYZ positioner was scanned to determine the position of maximum beam intensity for the instrument shown in FIGS. 1A and 1B. The non-circular appearance of the countours is due to the electrode geometry.

Figure 5:
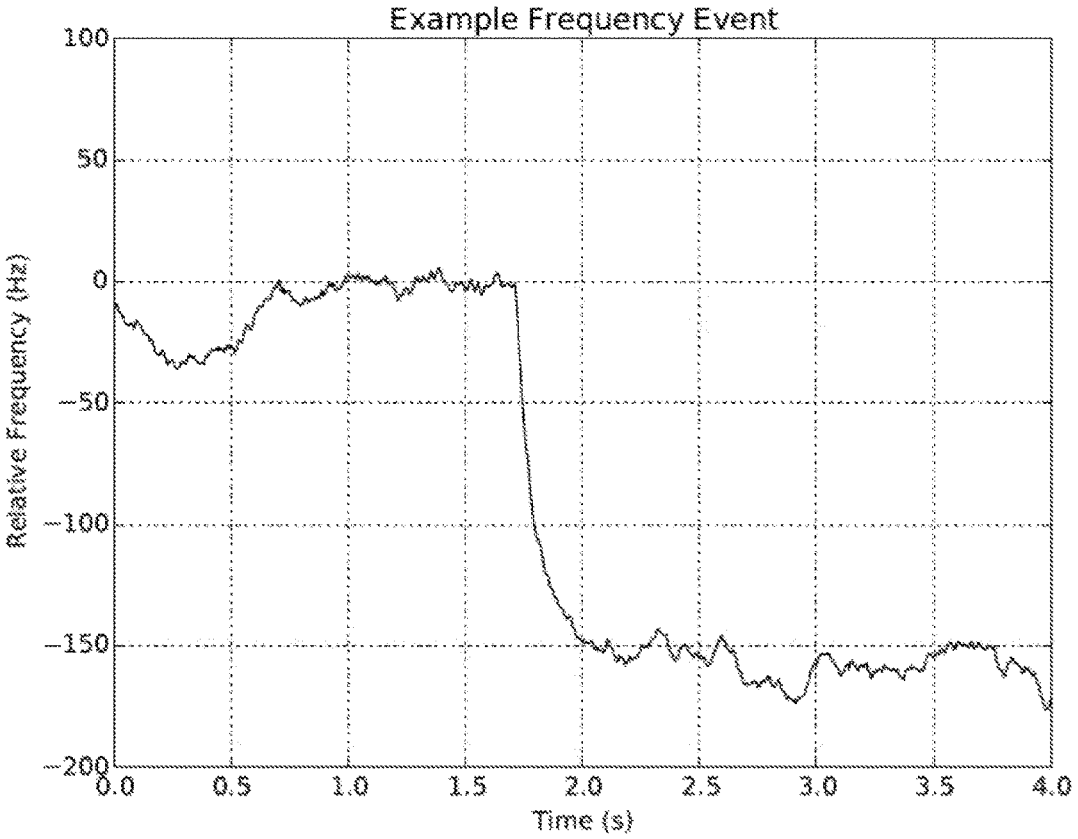
FIG. 5 is an example of a frequency shift due to adsorption of a GroEL molecule using the instrument shown in FIGS. 1A and 1B.

FIG. 5 is an example of a frequency shift due to adsorption of a GroEL molecule using the instrument shown in FIGS. 1A and 1B.

Figure 6:
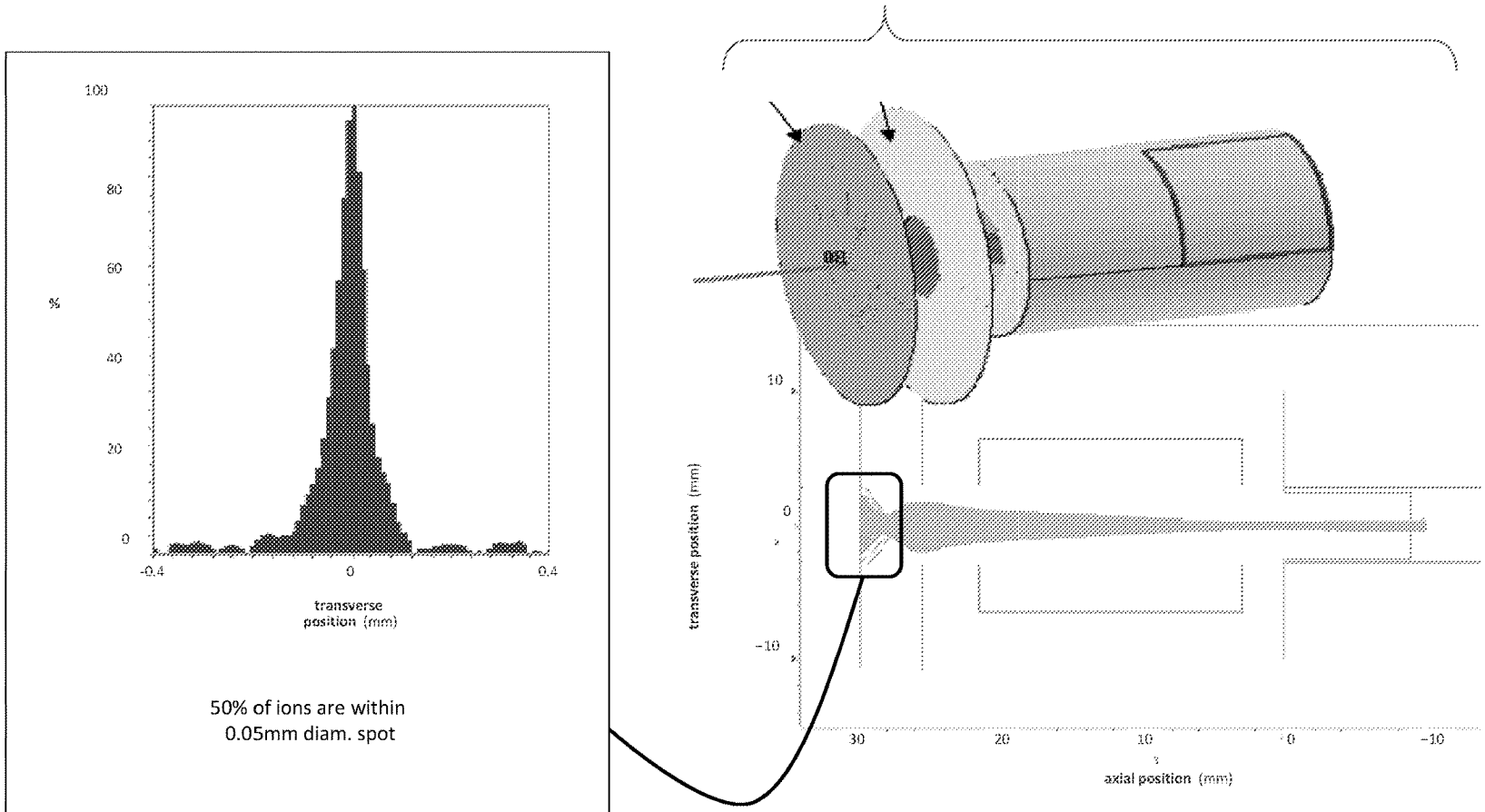
FIG. 6 shows that on the NEMS chip exposed to the ion beam 50% of ions are within 0.05 mm diameter spot.

FIG. 6 shows that 50% of ions are within 0.05 mm diameter of the spot as the ions strike the NEMS resonator. The graph shows transverse position (mm) versus axial position (mm). The ion lens and NEMS chip are also shown.

While the description provided herein constitutes a plurality of embodiments of the presently claimed invention or inventions, it will be appreciated that they are susceptible to further modification and change without departing from the fair meaning of the accompanying claims.

LISTING OF REFERENCES 1-80

1. Black, L. W., *DNA packaging in dsDNA bacteriophages*. Annu Rev Microbiol, 1989. 43: p. 267-92.
2. van Duijn, E., *Current limitations in native mass spectrometry based structural biology*. J Am Soc Mass Spectrom, 2010. 21(6): p. 971-8.
3. Lorenzen, K., A. S. Olia, C. Uetrecht, G. Cingolani, and A. J. R. Heck, *Determination of Stoichiometry and Conformational Changes in the First Step of the P22 Tail Assembly*. Journal of Molecular Biology, 2008. 379(2): p. 385-396.
4. Hanay, M. S., S. Kelber, A. K. Naik, D. Chi, S. Hentz, E. C. Bullard, E. Colinet, L. Duraffourg, and M. L. Roukes, *Single-protein nanomechanical mass spectrometry in real time*. Nat Nano, 2012. 7(9): p. 602-608.
5. Verbeck, G., W. Hoffmann, and B. Walton, *Soft-landing preparative mass spectrometry*. Analyst, 2012. 137(19): p. 4393-4407.
6. Uetrecht, C., C. Versluis, N. R. Watts, W. H. Roos, G. J. L. Wuite, P. T. Wingfield, A. C. Steven, and A. J. R. Heck, *High-resolution mass spectrometry of viral assemblies: Molecular composition and stability of dimorphic hepatitis B virus capsids. Proceedings of the National Academy of Sciences,* 2008.

7. Maguire, B. A., L. M. Wondrack, L. G. Contillo, and Z. Xu, *A novel chromatography system to isolate active ribosomes from pathogenic bacteria*. RNA, 2008. 14(1): p. 188-195.
8. Siibak, T., L. Peil, A. Donhofer, A. Tats, M. Remm, D. N. Wilson, T. Tenson, and J. Remme, *Antibioticinduced ribosomal assembly defects result from changes in the synthesis of ribosomal proteins.* Molecular Microbiology, 2011. 80(1): p. 54-67.
9. Nakashima, K., H. Shimada, T. Ochiai, M. Kuboshima, N. Kuroiwa, S. Okazumi, H. Matsubara, F. Nomura, M. Takiguchi, and T. Hiwasa, *Serological identification of TROP2 by recombinant cDNA expression cloning using sera of patients with esophageal squamous cell carcinoma*. International Journal of Cancer, 2004. 112(6): p. 1029-1035.
10. Goldstein, A. S., D. A. Lawson, D. Cheng, W. Sun, I. P. Garraway, and O. N. Witte, *Trop2 identifies a subpopulation of murine and human prostate basal cells with stem cell characteristics.* Proceedings of the National Academy of Sciences, 2008. 105(52): p. 20882-20887.
11. Ohmachi, T., F. Tanaka, K. Mimori, H. Inoue, K. Yanaga, and M. Mori, *Clinical Significance of TROP2 Expression in Colorectal Cancer. Clinical Cancer Research,* 2006. 12(10): p. 3057-3063.
12. Fong, D., P. Moser, C. Krammel, J. Gostner, R. Margreiter, M. Mitterer, G. Gastl, and G. Spizzo, *High expression of TROP2 correlates with poor prognosis in pancreatic cancer*. British Journal of Cancer, 2008. 99(8): p. 1290-1295.
13. Kobel, M., S. E. Kalloger, N. Boyd, S. McKinney, E. Mehl, C. Palmer, S. Leung, N. J. Bowen, D. N. Ionescu, and A. Rajput, *Ovarian carcinoma subtypes are different diseases: implications for biomarker studies*. PLoS medicine, 2008. 5(12): p. e232.
14. Fang, Y. J., Z. H. Lu, G. Q. Wang, Z. Z. Pan, Z. W. Zhou, J. P. Yun, M. F. Zhang, and D. S. Wan, *Elevated expressions of MMP7, TROP2, and survivin are associated with survival, disease recurrence, and liver metastasis of colon cancer*. International Journal of Colorectal Disease, 2009. 24(8): p. 875-884.
15. A. Loo, J., S. A. Benchaar, and J. Zhang, *Integrating Native Mass Spectrometry and Top-Down MS for Defining Protein Interactions Important in Biology and Medicine*. Mass Spectrometry, 2013. 2(Spec Iss): p. S0013.
16. Heck, A. J. R., *Native mass spectrometry: a bridge between interactomics and structural biology*. Nat Meth, 2008. 5(11): p. 927-933.
17. Loo, J. A., *Studying noncovalent protein complexes by electrospray ionization mass spectrometry*. Mass Spectrometry Reviews, 1997. 16(1): p. 1-23.
18. Loo, J. A., *Account: Mass spectrometry in the combinatorial chemistry revolution*. European Journal of Mass Spectrometry, 1997. 3(2): p. 93-104.
19. Yin, S. and J. A. Loo, *Elucidating the site of protein-ATP binding by top-down mass spectrometry*. Journal of the American Society for Mass Spectrometry, 2010. 21(6): p. 899-907.
20. Zhang, H., W. Cui, J. Wen, R. E. Blankenship, and M. L. Gross, *Native electrospray and electroncapture dissociation in FTICR mass spectrometry provide top-down sequencing of a protein component in an intact protein assembly*. Journal of the American Society for Mass Spectrometry, 2010. 21(12): p. 1966-1968.
21. Sinha, S., D. H. Lopes, Z. Du, E. S. Pang, A. Shanmugam, A. Lomakin, P. Talbiersky, A. Tennstaedt, K. McDaniel, and R. Bakshi, *Lysine-specific molecular tweezers are broad-spectrum inhibitors of assembly and toxicity of amyloid proteins*. Journal of the American Chemical Society, 2011. 133(42): p. 16958-16969.
22. Xie, Y., J. Zhang, S. Yin, and J. A. Loo, *Top-down ESI-ECD-FT-ICR mass spectrometry localizes noncovalent protein-ligand binding sites*. Journal of the American Chemical Society, 2006. 128(45): p. 14432-14433.
23. Barrera, N. P., M. Zhou, and C. V. Robinson, *The role of lipids in defining membrane protein interactions: insights from mass spectrometry*. Trends in cell biology, 2013. 23(1): p. 1-8.
24. Marcoux, J. and Carol V. Robinson, *Twenty Years of Gas Phase Structural Biology*. Structure, 2013. 21 (9): p. 1541-1550.
25. Ekinci, K. L., X. M. H. Huang, and M. L. Roukes, *Ultrasensitive nanoelectromechanical mass detection*. Applied Physics Letters, 2004. 84(22): p. 4469-4471.
26. Ilic, B., H. G. Craighead, S. Krylov, W. Senaratne, C. Ober, and P. Neuzil, *Attogram detection using nanoelectromechanical oscillators.* Journal of Applied Physics, 2004. 95(7): p. 3694-3703.
27. Yang, Y. T., C. Callegari, X. L. Feng, K. L. Ekinci, and M. L. Roukes, *Zeptogram-Scale Nanomechanical Mass Sensing*. Nano Letters, 2006. 6(4): p. 583-586.
28. Li, M., H. X. Tang, and M. L. Roukes, *Ultra-sensitive NEMS-based cantilevers for sensing, scanned probe and very high-frequency applications*. Nature Nanotechnology, 2007. 2(2): p. 114-120.
29. Gil-Santos, E., D. Ramos, J. Martinez, M. Fernandez-Regulez, R. Garcia, A. San Paulo, M. Calleja, and J. Tamayo, *Nanomechanical mass sensing and stiffness spectrometry based on twodimensional vibrations of resonant nanowires*. Nature Nanotechnology, 2010. 5(9): p. 641-5.
30. Chen, C. Y., S. Rosenblatt, K. I. Bolotin, W. Kalb, P. Kim, I. Kymissis, H. L. Stormer, T. F. Heinz, and J. Hone, *Performance of monolayer graphene nanomechanical resonators with electrical readout*. Nature Nanotechnology, 2009. 4(12): p. 861-867.
31. Naik, A. K., M. S. Hanay, W. K. Hiebert, X. L. Feng, and M. L. Roukes, *Towards single-molecule nanomechanical mass spectrometry*. Nat Nano, 2009. 4(7): p. 445-450.
32. Schmid, S., M. Kurek, J. Q. Adolphsen, and A. Boisen, *Real-time single airborne nanoparticle detection with nanomechanical resonant filter-fiber*. Sci Rep, 2013. 3: p. 1288.
33. Gupta, A., D. Akin, and R. Bashir, *Single virus particle mass detection using microresonators with nanoscale thickness*. Applied Physics Letters, 2004. 84(11): p. 1976-1978.
34. Burg, T. P., M. Godin, S. M. Knudsen, W. Shen, G. Carlson, J. S. Foster, K. Babcock, and S. R. Manalis, *Weighing of biomolecules, single cells and single nanoparticles in fluid*. Nature, 2007. 446(7139): p. 1066-1069.
35. Jensen, K., K. Kim, and A. Zettl, *An atomic-resolution nanomechanical mass sensor*. Nature Nanotechnology, 2008. 3(9): p. 533-7.
36. Chiu, H. Y., P. Hung, H. W. Postma, and M. Bockrath, *Atomic-scale mass sensing using carbon nanotube resonators*. Nano Lett, 2008. 8(12): p. 4342-6.
37. Lassagne, B., D. Garcia-Sanchez, A. Aguasca, and A. Bachtold, *Ultrasensitive mass sensing with a nanotube electromechanical resonator*. Nano Lett, 2008. 8(11): p. 3735-8.

38. Chaste, J., A. Eichler, J. Moser, G. Ceballos, R. Rurali, and A. Bachtold, *A nanomechanical mass sensor with yoctogram resolution.* Nature Nanotechnology, 2012. 7(5): p. 300-303.

39. Hanay, M. S., S. I. Kelber, C. O'Connell, P. Mulvaney, J. E. Sader, and M. L. Roukes, *Inertial Imaging with Nanomechanical Systems*. Nature Nanotechnology, Vol. 10, 339-344, April 2015.

40. Pearson, K., *Contributions to the mathematical theory of evolution. II. Skew variation in homogeneous material*. Philosophical Transactions of the Royal Society of London. A, 1895. 186: p. 343-414.

41. Maetzel, D., S. Denzel, B. Mack, M. Canis, P. Went, M. Benk, C. Kieu, P. Papior, P. A. Baeuerle, M. Munz, and O. Gires, *Nuclear signalling by tumour-associated antigen EpCAM*. Nat Cell Biol, 2009. 11(2): p. 162-171.

42. Stoyanova, T., A. S. Goldstein, H. Cai, J. M. Drake, J. Huang, and O. N. Witte, *Regulated proteolysis of Trop2 drives epithelial hyperplasia and stem cell self-renewal via β-catenin signaling*. Genes & Development, 2012. 26(20): p. 2271-2285.

43. Lal, M. and M. Caplan, *Regulated Intramembrane Proteolysis: Signaling Pathways and Biological Functions*. Physiology, 2011. 26(1): p. 34-44.

44. Hanahan, D. and R. A. Weinberg, *Hallmarks of Cancer: The Next Generation*. Cell, 2011. 144(5): p. 646-674.

45. Aller, S. G., J. Yu, A. Ward, Y. Weng, S. Chittaboina, R. Zhuo, P. M. Harrell, Y. T. Trinh, Q. Zhang, I. L. Urbatsch, and G. Chang, *Structure of P-Glycoprotein Reveals a Molecular Basis for Poly-Specific Drug Binding*. Science, 2009. 323(5922): p. 1718-1722.

46. Marcoux, J., S. C. Wang, A. Politis, E. Reading, J. Ma, P. C. Biggin, M. Zhou, H. Tao, Q. Zhang, G. Chang, N. Morgner, and C. V. Robinson, *Mass spectrometry reveals synergistic effects of nucleotides, lipids, and drugs binding to a multidrug resistance efflux pump*. Proceedings of the National Academy of Sciences, 2013.

47. Laskin, J., *Ion-surface collisions in mass spectrometry: Where analytical chemistry meets surface science*. International Journal of Mass Spectrometry, (0).

48. Shen, J., Y. H. Yim, B. Feng, V. Grill, C. Evans, and R. G. Cooks, *Soft landing of ions onto selfassembled hydrocarbon and fluorocarbon monolayer surfaces*. International Journal of Mass Spectrometry, 1999. 182-183(0): p. 423-435.

49. Siuzdak, G., B. Bothner, M. Yeager, C. Brugidou, C. M. Fauquet, K. Hoey, and C.-M. Change, *Mass spectrometry and viral analysis.* Chemistry & Biology, 1996. 3(1): p. 45-48.

50. Ouyang, Z., Z. Takats, T. A. Blake, B. Gologan, A. J. Guymon, J. M. Wiseman, J. C. Oliver, V. J. Davisson, and R. G. Cooks, *Preparing Protein Microarrays by Soft-Landing of Mass-Selected Ions.* Science, 2003. 301 (5638): p. 1351-1354.

51. Mikhailov, V. A., T. H. Mize, J. L. P. Benesch, and C. V. Robinson, *Mass-Selective Soft-Landing of Protein Assemblies with Controlled Landing Energies*. Analytical Chemistry, 2014. 86(16): p. 8321-8328.

52. Wang, P. and J. Laskin, *Surface Modification Using Reactive Landing of Mass-Selected Ions*, in *Ion Beams in Nanoscience and Technology*, R. Hellborg, H. J. Whitlow, and Y. Zhang, Editors. 2010, Springer Berlin Heidelberg. p. 37-65.

53. Alvarez, J., J. H. Futrell, and J. Laskin, *Soft-Landing of Peptides onto Self-Assembled Monolayer Surfaces*†. The Journal of Physical Chemistry A, 2005. 110(4): p. 1678-1687.

54. Hadjar, O., P. Wang, J. H. Futrell, and J. Laskin, *Effect of the Surface on Charge Reduction and Desorption Kinetics of Soft Landed Peptide Ions*. Journal of the American Society for Mass Spectrometry, 2009. 20(6): p. 901-906.

55. Miller, S. A., H. Luo, S. J. Pachuta, and R. G. Cooks, *Soft-Landing of Polyatomic Ions at Fluorinated Self-Assembled Monolayer Surfaces.* Science, 1997. 275 (5305): p. 1447-1450.

56. Hadjar, O., J. H. Futrell, and J. Laskin, *First Observation of Charge Reduction and Desorption Kinetics of Multiply Protonated Peptides Soft Landed onto Self-Assembled Monolayer Surfaces.* The Journal of Physical Chemistry C, 2007. 111(49): p. 18220-18225.

57. Golovlev, V., S. Allman, W. Garrett, N. Taranenko, and C. Chen, *Laser-induced acoustic desorption*. International journal of mass spectrometry and ion processes, 1997. 169: p. 69-78.

58. Ma, X., L. B. Lai, S. M. Lai, A. Tanimoto, M. P. Foster, V. H. Wysocki, and V. Gopalan, *Uncovering the Stoichiometry of Pyrococcus Furiosus RNase P, a Multi-Subunit Catalytic Ribonucleoprotein Complex, by Surface Induced Dissociation and Ion Mobility Mass Spectrometry.* Angewandte Chemie, 2014. 126(43): p. 11667-11671.

59. Rosati, S., R. J. Rose, N. J. Thompson, E. van Duijn, E. Damoc, E. Denisov, A. Makarov, and A. J. Heck, *Exploring an orbitrap analyzer for the characterization of intact antibodies by native mass spectrometry.* Angewandte Chemie International Edition, 2012. 51(52): p. 12992-12996.

60. Rose, R. J., E. Damoc, E. Denisov, A. Makarov, and A. J. Heck, *High-sensitivity Orbitrap mass analysis of intact macromolecular assemblies.* Nature methods, 2012. 9(11): p. 1084-1086.

61. Cleland, A. N. R., M. L., *A nanometer-scale mechanical electrometer.* Nature, 1998. 392: p. 160-162.

62. Cho, W. C. S., *Contribution of oncoproteomics to cancer biomarker discovery*. Molecular Cancer, 2007. 6.

63. Cho, W. C. S. and C. H. K. Cheng, *Oncoproteomics: current trends and future perspectives*. Expert Review of Proteomics, 2007. 4(3): p. 401-410.

64. Charlotte Uetrecht, I. M. B., Glen K. Shoemaker, Esther van Duijn, Albert J. R. Heck, *Interrogating viral capsid assembly with ion mobility—mass spectrometry*. Nature Chemistry, 2011. 3.

65. McKay, A. R., B. T. Ruotolo, L. L. Ilag, and C. V. Robinson, *Mass Measurements of Increased Accuracy Resolve Heterogeneous Populations of Intact Ribosomes*. Journal of the American Chemical Society, 2006. 128(35): p. 11433-11442.

66. Uetrecht, C., C. Versluis, N. R. Watts, W. H. Roos, G. J. L. Wuite, P. T. Wingfield, A. C. Steven, and A. J. R. Heck, *High-resolution mass spectrometry of viral assemblies: Molecular composition and stability of dimorphic hepatitis B virus capsids*. Proceedings of the National Academy of Sciences of the United States of America, 2008. 105(27): p. 9216-9220.

67. Snijder, J., R. J. Rose, D. Veesler, J. E. Johnson, and A. J. R. Heck, *Studying* 18 *MDa Virus Assemblies with Native Mass Spectrometry.* Angewandte Chemie-International Edition, 2013. 52(14): p. 4020-4023.

68. Sage, E., et al., *Neutral Particle Mass Spectrometry with Nanomechanical Systems*, Nat. Comm., 2015, DOI: 10.1038/ncomms7482, 2013.

69. von Helden, G., T. Wyttenbach, and M. T. Bowers, *Conformation of Macromolecules in the Gas Phase: Use*

*of Matrix-Assisted Laser Desorption Methods in Ion Chromatography*. Science, 1995. 267(5203): p. 1483-1485.

70. Clemmer, D. E., R. R. Hudgins, and M. F. Jarrold, *Naked Protein Conformations: Cytochrome c in the Gas Phase*. Journal of the American Chemical Society, 1995. 117(40): p. 10141-10142.
71. Wittmer, D., Y. H. Chen, B. K. Luckenbill, and H. H. Hill, *Electrospray Ionization Ion Mobility Spectrometry*. Analytical Chemistry, 1994. 66(14): p. 2348-2355.
72. Bohrer, B. C., S. I. Merenbloom, S. L. Koeniger, A. E. Hilderbrand, and D. E. Clemmer, *Biomolecule Analysis by Ion Mobility Spectrometry*. Annual Review of Analytical Chemistry, 2008. 1(1): p. 293-327.
73. Hilton, G. C., J. M. Martinis, D. A. Wollman, K. D. Irwin, L. L. Dulcie, D. Gerber, P. M. Gillevet, and D. Twerenbold, *Impact energy measurement in time-of-flight mass spectrometry with cryogenic microcalorimeters*. Nature, 1998. 391(6668): p. 672-675.
74. Cleland, A. and M. Roukes, *Noise processes in nanomechanical resonators*. Journal of Applied Physics, 2002. 92(5): p. 2758-2769.
75. Villanueva, L., E. Kenig, R. Karabalin, M. Matheny, R. Lifshitz, M. Cross, and M. Roukes, *Surpassing fundamental limits of oscillators using nonlinear resonators*. Physical review letters, 2013. 110(17): p. 177208.
76. Li, M., E. B. Myers, H. X. Tang, S. J. Aldridge, H. C. McCaig, J. J. Whiting, R. J. Simonson, N. S. Lewis, and M. L. Roukes, *Nanoelectromechanical resonator arrays for ultrafast, gas-phase chromatographic chemical analysis*. Nano Lett, 2010. 10(10): p. 3899-903.
77. Bargatin, I., E. B. Myers, J. S. Aldridge, C. Marcoux, P. Brianceau, L. Duraffourg, E. Colinet, S. Hentz, P. Andreucci, and M. L. Roukes, *Large-scale integration of nanoelectromechanical systems for gas sensing applications*. Nano Lett, 2012. 12(3): p. 1269-74.
78. LaHaye, M., J. Suh, P. Echternach, K. Schwab, and M. Roukes, *Nanomechanical measurements of a superconducting qubit*. Nature, 2009. 459(7249): p. 960-964.
79. Chan, J., T. P. M. Alegre, A. H. Safavi-Naeini, J. T. Hill, A. Krause, S. Groblacher, M. Aspelmeyer, and O. Painter, *Laser cooling of a nanomechanical oscillator into its quantum ground state*. Nature, 2011. 478(7367): p. 89-92.
80. Suh, J., A. J. Weinstein, C. Lei, E. Wollman, S. Steinke, P. Meystre, A. Clerk, and K. Schwab, *Mechanically Detecting and Avoiding the Quantum Fluctuations of a Microwave Field*. Science, 2014.

What is claimed is:

1. A mass spectrometer apparatus comprising:

at least one hybrid mass spectrometer comprising:

an ion source for generating ions from a sample, a first mass spectral system comprising a nanoelectromechanical mass spectral (NEMS-MS) system, a second mass spectral system including at least one mass analyzer adapted to separate the charged particles according to their mass-to-charge ratios, an integration zone coupling the first and second mass spectral systems, the integration zone including at least one directional device for controllably routing the ions to a selected one or both of the first and second mass spectral systems for analysis thereby.

2. The apparatus of claim 1, wherein the integration zone comprises at least one quadrupole, at least one aperture, and at least one electrostatic lens.

3. The apparatus of claim 1, wherein the first and second mass spectral systems are further integrated with a system interface comprising a transfer chamber and ion optics.

4. The apparatus of claim 1, wherein the second mass spectral system comprises a at least one mass analyzer selected from a group consisting of: an electrostatic trap (EST) analyzer, an EST analyzer of orbital type, a time-of-flight (TOF) analyzer, a Fourier transform ion cyclotron resonance (FT ICR) analyzer, a quadrupole mass filter analyzer, and an ion trap analyzer.

5. The apparatus of claim 1, wherein the second mass spectral system or the integration zone comprises at least one dissociation or collision cell.

6. The apparatus of claim 1, wherein the NEMS-MS system comprises at least one chip comprising at least one micro-mechanical and/or nano-mechanical resonator.

7. The apparatus of claim 1, wherein the NEMS-MS system comprises at least one chip comprising a plurality of micro-mechanical and/or nano-mechanical resonators.

8. The apparatus of claim 1, wherein the NEMS-MS system comprises at least one chip comprising at least one micro-mechanical and/or nano-mechanical resonator comprising a resonator surface adapted so that an analyte fragmentation is avoided when the analyte is adsorbed to the resonator surface.

9. The apparatus of claim 1, wherein the NEMS-MS system comprises at least one chip comprising at least one micro-mechanical and/or nanomechanical resonator, wherein the NEMS-MS system is further adapted for analysis of analyte while the analyte is adsorbed to the at least one micro-mechanical and/or nano-mechanical resonator.

10. The apparatus of claim 1, wherein the first mass spectral system is adapted for pixel-by-pixel desorption.

11. The apparatus of any of claim 1, wherein the first mass spectral system is adapted for desorption from the first mass spectral system, wherein desorption is achieved by thermal, electrostatic, acoustic, optical, shock, or piezoelectric-mechanical methods.

12. The apparatus of claim 1, wherein the first and second mass spectral systems are further integrated with use of an electrical directional device which electrically directs the ion beam to the first and/or second mass spectral systems, wherein the directional device is an HCD collision cell, wherein also the second mass spectral system comprises a C-trap and an orbital electrostatic trap mass analyzer, and wherein the NEMS-MS system comprises at least one chip comprising a plurality of micro-mechanical and/or nano-mechanical resonators.

13. A method of analyzing molecules comprising:

generating ions in an ion source from a sample of molecules to be analyzed;

analyzing at least some of said ions according to their mass-to-charge ratio in a mass analyzer;

obtaining spectra of analyzed ions;

wherein mass analysis is complemented by:

diverting at least some of ions from the ion source to an electromechanical device that measurably changes one of its characteristics upon adsorption of a single ion to be analyzed;

measuring change of said characteristics upon adsorption for a multitude of adsorbed ions and converting its amplitude into characteristics of mass distribution within each ion;

wherein statistical distributions from multiple measurements are used for assigning charge state and mass of peaks in a spectrum obtained by mass analyzer.

14. The method of claim 13, wherein the mass analyzer is an orbital electrostatic trap mass analyzer.

15. The method of claim 13, wherein the electromechanical device comprises one or more micro-mechanical and/or nano-mechanical resonators.

* * * * *